US006116722A

United States Patent [19]

Sato et al.

[11] Patent Number: 6,116,722

[45] **Date of Patent: *Sep. 12, 2000**

[54] INK JET INK REFILLING METHOD AND APPARATUS

[75] Inventors: Osamu Sato, Kawasaki; Masanori Takenouchi, Yokohama; Sadayuki Sugama, Tsukuba; Hiroyuki Inoue, Yokohama; Takayoshi Tsutsumi, Tokyo; Yasuo Kotaki, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/521,834

[22] Filed: Aug. 31, 1995

[30] Foreign Application Priority Data

Aug. 31, 1994 [JP] Japan ..... 6-207573
Dec. 27, 1994 [JP] Japan ..... 6-325427

[51] Int. Cl.[7] ..... B41J 2/175
[52] U.S. Cl. ..... 347/85
[58] Field of Search ..... 347/85, 86, 87; 141/37, 4

[56] References Cited

U.S. PATENT DOCUMENTS 4,368,478 1/1983 Koto ..... 347/86
5,119,115 6/1992 Buat et al. .
5,280,299 1/1994 Saikawa et al. ..... 347/87

FOREIGN PATENT DOCUMENTS 536 980 4/1993 European Pat. Off. .
605183 7/1994 European Pat. Off. .
655335 5/1995 European Pat. Off. .
3401071 7/1985 Germany .
58-163666 9/1983 Japan ..... 347/86
07001744 1/1995 Japan .

*Primary Examiner*—N. Le
*Assistant Examiner*—Judy Nguyen
*Attorney, Agent, or Firm*—Fitzpatrick, Cella, Harper & Scinto

[57] ABSTRACT

An ink refilling method for an ink container having a porous material capable of producing negative pressure therein and having an ink absorbing portion in a connecting zone with an ink jet recording head, after at least a part of initially contained ink is consumed through the ink absorbing portion includes breaking ink meniscus at the ink absorbing portion of the ink container; supplying the ink into the ink container by a negative pressure produced in the porous material by consumption of the ink, while maintaining fluid communication between the ink absorbing portion and the ink to be supplied.

19 Claims, 25 Drawing Sheets

INK JET INK REFILLING METHOD AND APPARATUS

FIELD OF THE INVENTION AND RELATED ART

The present invention relates to a refilling container, a refilling method and a refilling apparatus for refilling ink into an ink container for containing the ink to be supplied to an ink jet recording head for an ink jet recording apparatus.

An ink jet unit in the form of a cartridge having integral recording head and ink container, has been used in an ink jet recording field, from the standpoint of downsizing of the apparatus and maintenance free or the like. The ink jet unit is detachably mountable to a carrying carriage of the recording apparatus, and when the ink is used up, the ink jet unit is replaced by a user with a fresh ink jet unit.

In an ink jet recording field, the demand is strong for a color recording. As a structure for satisfying the demand for the color recording in the case of the ink jet unit, the following systems are used. For example, ink jet units for respective colors are arranged along a direction of the scanning of the carriage. In another system, a color ink jet unit and a black ink jet unit are carried on a carriage, wherein the color ink jet unit has integral recording head and ink containers for containing yellow, magenta, cyan inks for the color recording. On the other hand, another type ink jet unit has been proposed in which the recording head with which the ink in the ink jet unit has been used up is not disposed if the recording head is still usable.

As one of such proposals, the ink is refilling into an ink container of the ink jet unit. For example, a metal injection needle is used to charge the ink container. Or, the ink container is in the form of an injector to permit pressurized refilling.

The above refilling methods involve the following problems. First, since the operation is performed manually, the pressure tends to be too high with the result that the ink supply speed is too high as compared with the ink seeping speed into the ink absorbing material. If this occurs, the ink overflows through the hole through which the injection needle is penetrated. Since the remaining amount of the ink in the ink container is not known, the ink tends to be overcharged with the result of the same overflow of the ink. In order to refill the ink without the overflowing, the pressure has to be maintained at a predetermined level with the result of complicated structure. Additionally, since the refilling is effected manually, the operator has to be engaged in the refilling operation for a relatively long period. In the bellow type or injection type ink container, the resistance is low before the needle is penetrated into the ink container, and therefore, the ink leaks out through the needle upon small shock.

For such an ink jet unit with which the ink container is replaceable, it will be considered to refill the ink through the opening through which the recording head and the ink container are connected with each other. However, the problems described above are still involved. Particularly, the opening through which the ink container and the recording head are connected with each other, is relatively large as compared with the needle of the ink refilling device, and therefore, the ink overflow problem is more significant. Such ink refilling operations are to be carried out under the control of the external supply capacity, and therefore, the proper ink refilling for the ink container is not easily carried out.

In order to improve the situations, it has been proposed that a refilling ink container is mounted to the top of the ink container having been used up, and the ink is refilled using the static head difference without any forced pressurization.

In such an apparatus, the ink refilling speed follows the ink seeping speed of the ink absorbing material, and therefore, the ink does not overflow. However, since all of the ink in the refilling container holds into the ink container, and therefore, the quantity of the ink refilling container is larger than the ink absorbing capacity of the ink container, the ink may overflow through the connecting portion between the refilling device and the ink container. Therefore, this method is still not satisfactory.

Japanese Laid-Open Patent Application No. 1744/1995 proposes that there are provided an ink cartridge (ink container) and a chamber for accommodating the ink to fill the ink by capillary force. However, the ink supply passage during the printing and the ink refilling position are different, and therefore, it is necessary to push a capillary element to the sponge material to assure the filling. Then, the compression state of the sponge is different between the neighborhood of the printing head and the neighborhood of the refilling position. If the ink is refilled into the ink cartridge (ink container) after the ink is used up. The air may be introduced into between the different compressed zones of the sponge with the result of incapability of the printing.

With this structure, the capillary element has a large length with the result of large flow resistance with the result of a long time period required for the filling. Or, when the ink in the chamber reduces, the pressure in the chamber decreases tending to suck the air in. However, there is no port for permitting the introduction of the air, and therefore, the refilling operation stops.

It is known that the ink container containing porous material capable of absorbing the ink is such that the pores of the porous material produces sucking force by small negative pressure resulting from the ink consumption despite the ink container is in fluid communication with the ambience. This is used for the ink container refilling in this invention to permit assured ink filling without ink overflow.

Due to the negative pressure produced with ink consumption in the ink container, the ink is not consumed and remains adjacent the ink supply port. Even if the ink container is separated from a recording head, ink absorbing portion adjacent the ink supply side (or a separate member connected with the porous material), involves the ink which forms a meniscus. In other words, all of the initially filled ink is not consumed by the recording, and therefore, the residual or remaining ink necessarily exist at the ink refilling position.

SUMMARY OF THE INVENTION

Accordingly, it is a principal object of the present invention to provide an ink refilling method and apparatus wherein the ink overflow or leakage is prevented.

It is another object of the present invention to provide an ink refilling method and apparatus wherein the operativity in the refilling of the ink is improved without ink overflow, by providing the quantity of the ink refilling proper for the ink container to be refilled.

It is a further object of the present invention to provide an ink refilling method and apparatus in which the ink refilling is ruled by the negative pressure produced by the ink consumption from the ink container, so that the ink container may be left as it is after refilled.

It is a further object of the present invention to provide an ink refilling method and apparatus in which a head difference of the ink in the refilling operation is made constant.

It is a further object of the present invention to provide an ink refilling method and apparatus in which small ink deposition is prevented.

According to an aspect of the present invention, the use is made with the negative pressure produced by the consumption of the ink retained in the porous material in the ink container in order to prevent overcharge of the ink into the ink container and to prevent the ink overflow. Particularly preferably, the meniscus of the ink remaining adjacent the ink outlet side of the ink container is broken to permit refilling of the ink without the ink discontinuity.

According to an aspect of the present invention, there is provided an ink refilling method for an ink container having a porous material capable of producing negative pressure therein and having an ink absorbing portion in a connecting zone with an ink jet recording head, after at least a part of initially contained ink is consumed through the ink absorbing portion, comprising: breaking ink meniscus at the ink absorbing portion of the ink container; supplying the ink into the ink container by a negative pressure produced in the porous material by consumption of the ink, while maintaining fluid communication between the ink absorbing portion and the ink to be supplied.

The ink meniscus breakage step or means includes breakage of at least a part of the meniscus produced by the negative pressure in the ink container having the ink remaining at least in the ink container to permit fluid communication with the ink to be refilled. It may be accomplished by pressurization of the ink to be refilled or by sucking of the ink in the ink container. As a further preferable example, the ink to be refilled is raised by capillary force provided in a small gap between rod or needles having small cross-sections, and the ink is inserted into the ink absorbing material in the ink container together with the rods. The breakage step or means includes an ink absorbing material in the ink container is immersed in the refilling ink container, and the external vibration force is applied. Another example is that the ink container itself is moved toward and away from the ink to be refilled, several times to break the meniscus.

According to another aspect of the present invention, the ink absorbing portion is disposed below a low position, and the porous material is above the ink absorbing material to supply the ink upwardly.

By doing so, the ink can be assuredly filled from the ink supply side.

According to a further aspect of the present invention, the ink absorbing portion of the ink container has an ink discharging member having a bundle of uni-directional fibers with an end contacted to the porous material, and wherein the meniscus is formed at the other end of the ink discharging member.

By doing so, the refilled ink exists more uniformly in the ink container. When the ink is supplied downwardly from the ink container into the recording head (preferably directly downwardly, when the ink container is used for the recording, the remaining ink in the ink container during the refilling, is made uniform and concentrated in the ink supply side. Therefore, the refilling method and apparatus of this invention is further effective According to a further aspect of the present invention, the ink container has a plurality of ink accommodating chamber for different color inks, and the ink accommodating chambers contain porous materials, respectively, and wherein the connecting zones of the respective ink accommodating chambers are on the same plane, and the inks to be supplied includes different inks corresponding to the respective ink accommodating chambers, and are supplied respectively to the respective ink absorbing portions.

The ink refilling into different ink containers having different consumed amounts can be refilled without overage and without ink mixture. The operation is easy.

According to a further aspect of the present invention, it is noted that the state of the ink refilling slightly changes by the change of the level of the ink to be refilled during the refilling action, and the ink to be supplied is contained in a container which maintains a level of the ink therein substantially the same as a level at which the ink absorbing portion receives the ink to be supplied thereto.

By doing so, the refilling action is ruled or controlled by the negative pressure produced by the consumption of the ink in the ink container, thus further uniforming the refilled state of the ink in the ink container.

According to a further aspect of the present invention, there is provided an ink refilling apparatus comprising: an ink tank holder to which an ink container for an ink jet recording head, having an ink absorbing portion at a portion for connection with the ink jet recording head and having an ink retaining member in the form of a porous material capable of producing a negative pressure therein; ink discharging means for retaining the ink to be supplied into the ink container and for supplying the ink to the ink absorbing material in the ink container; means for breaking a meniscus of the ink absorbing material, the meniscus breaking means is provided in the ink discharging means; after fluid communication between the ink in the ink absorbing material and the ink retained in the discharging means is established by the meniscus breaking means, the ink is supplied into the ink container by the negative pressure produced by the consumption of the ink from the ink container.

According to a further aspect of the present invention, there is provided an ink refilling apparatus comprising: an ink tank holder to which an ink container for an ink jetting recording head, having an ink absorbing portion at a portion for connection with the ink jet recording head and having an ink retaining member in the form of a porous material capable of producing a negative pressure therein; ink discharging means for retaining the ink to be supplied into the ink container and for supplying the ink to the ink absorbing material in the ink container; means for breaking a meniscus of the ink absorbing material, the meniscus breaking means is provided in the ink discharging means; after fluid communication between the ink in the ink absorbing material and the ink retained in the discharging means is established by the meniscus breaking means, the ink is supplied into the ink container by the negative pressure produced by the consumption of the ink from the ink container, and the ink container retaining portion is an ink container retaining member of the ink jet recording head.

Thus, there is no need of using positioning means, fixing means, and the operativity is improved with high stability. Thus, inexpensive and highly reliable ink refilling apparatus can be provided.

In many cases, from the standpoint of the productivity and cost, common nozzle part of the ink jet recording head are used, and the ink container, and an ink container holder of the ink jet recording head, are adopted to be optimum. In such a case, the negative pressure in the ink container is selected for the nozzle of the recording head. According to an aspect of the present invention, it is possible to use an ink discharging means for retaining the ink to be refilled in the ink container and for supplying the ink to the ink absorbing material. According to this aspect of the present invention, the ink holder of the ink refilling apparatus is exchangeable to match the recording head used, or a plurality of them are used. Thus, the number of required types of ink refilling apparatus is reduced, thus providing an inexpensive and utility ink refilling apparatus.

According to an aspect of the present invention, it is noted that the change of the level of the ink to be refilled during the ink refilling operation results in slight change of the ink refilling state. In consideration of this, the ink to be refilled is supported to a container for maintaining liquid surface level equivalent to the position where the ink absorbing material receives the ink to be refilled. By doing so, the refilling is further controlled by the negative pressure produced by the ink consumption in the ink container, thus further uniforming the refilled state of the ink in the ink container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
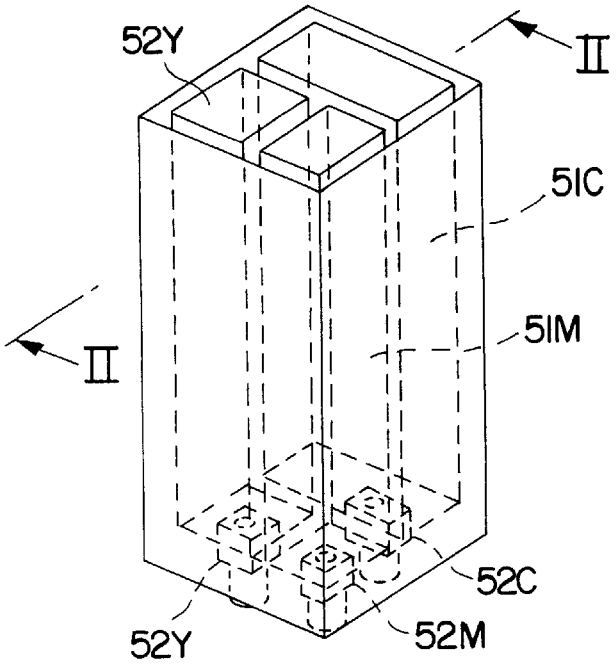
FIG. 1 is a perspective view of a head holder to which an ink container is mounted.

FIG. 1 shows an ink container mounted to a head holder. Designated by reference numeral 51 (Y, C, M) is an ink retaining member in the form of a porous material; 52 (Y, C, M) is a compressed ink absorbing material mounted to the connecting portion between the ink retaining member and the opening. The material of the ink retaining member 51 (Y, X, C) is an absorbing material of foamed polyurethane, and the material of the compressed material 52 (Y, M, C) is provided by sintering polyester fibers with resin binder and cutting it into proper size.

Figure 2:
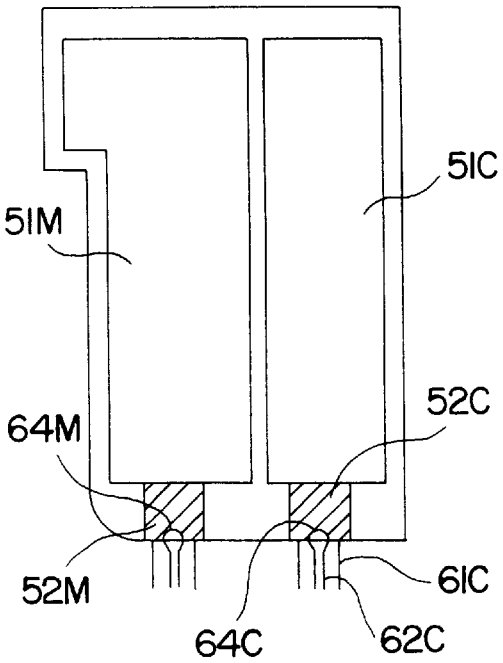
FIG. 2 is a sectional view taken along a line II—II in FIG. 1

FIG. 2 is a sectional view taken along a line II—II in which the ink container is connected with the head holder. Designated by 61 (Y, M, C) is a pin extending from the holder, and has an ink passage 62 (Y, M, C) which opens at the end. It functions as an ink passage when it is press-inserted into the compressed member 52 (Y, M, C) exposed through the opening of the ink container. To permit the stabilized ink supply, the compressed member is provided with a filter 64 (Y, M, C).

When the ink is used, the ink is concentrated in the compressed material 52 side having larger capillary force than the ink retaining member 51. As long as the ink is taken out from an end surface thereof, the ink is stably supplied through the ink passage 62.

Figure 3:
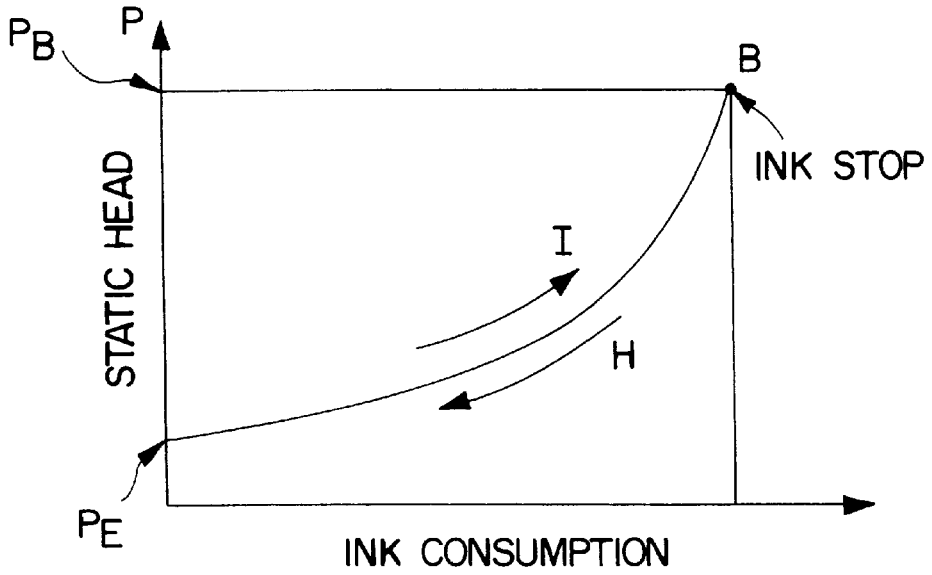
FIG. 3 is a graph of ink consumption in the ink container vs. static head.

If the static head P produced by the ink retaining member 51 and the compressed member 52 may be too large even before the in remains in the ink container, the air may be introduced from the compressed member 52 and the retaining member 51 or from between the filter 64 and the compressed member 52 with the result of discontinuity of the ink. FIG. 3 shows a relationship between the used quantity of the ink and the static head P at this time.

In FIG. 3, designated by B is the occurrence of the ink discontinuity. The position B changes by changing the state of contact between the retaining member 51 and the compressed member 52 or by the state of contact between the filter 64 and the compressed member 52, since then the easiness of air introduction changes. Usually, however, when the foamed polyurethane is used, it is 100–150 Aq.

Figure 4:
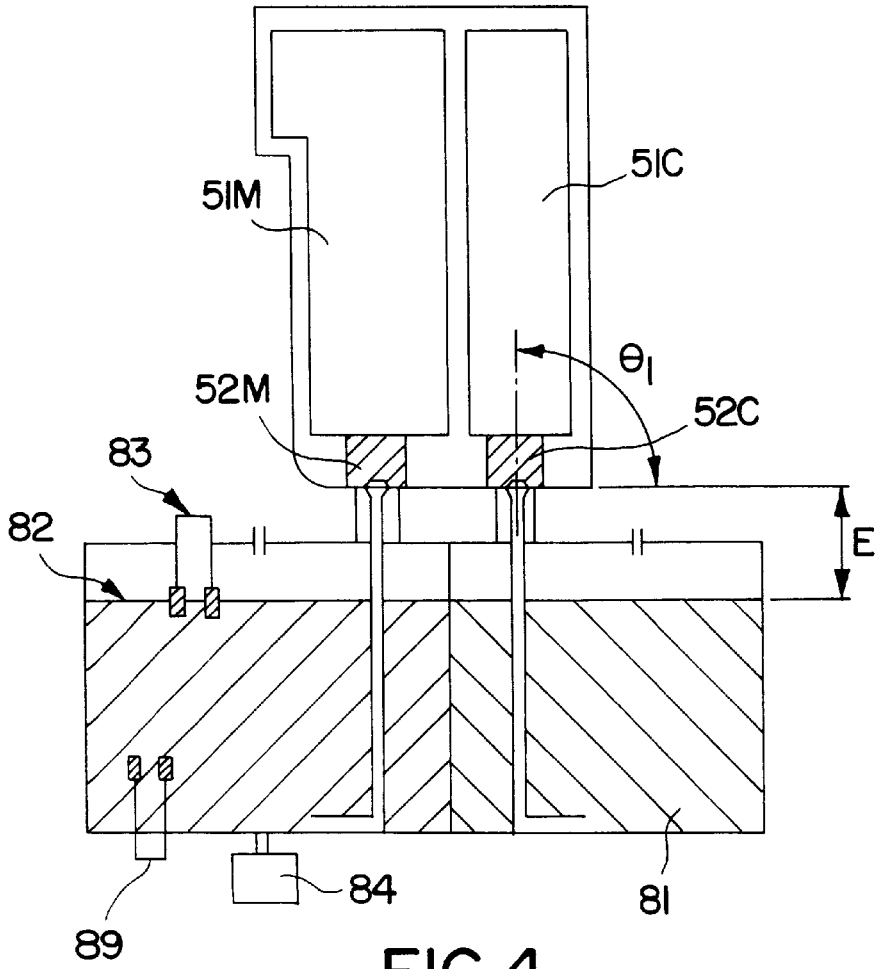
FIG. 4 is a schematic sectional view of an example of connection between the ink container and the ink refilling apparatus according to an embodiment of the present invention.

FIG. 4 shows a basic mechanism of the ink refilling. When the static head produced by the retaining member 51C and the compressed member 52C retaining the cyan ink (C) in FIG. 2 reaches the point B in FIG. 3, the ink refilling apparatus is connected with the ink container as shown in FIG. 4. Thus, the ink in the ink refilling apparatus communicates with the ink remaining in the ink container through the compressed member 52. Then, the ink in the ink reservoir 81 is sucked up into the ink container by the static negative head Pb (FIG. 3) produced by the retaining member 51C and the compressed member 52C. At this time the change of the static negative head at the end of the ink container is in the direction R which is reverse in the case of the use of the ink in FIG. 3.

In this case, however, the ink is sucked up until the equilibrium of pressure balance by the retaining member 51C and the compressed member 52C is reached. So, if no control is carried out for the ink refilling quantity, the pressure in the ink container becomes slightly over pressured beyond the static negative pressure PE required for the ink container at the initial stage. According to this embodiment, to avoid this, the force of sucking the ink up in the capillary tube, is changeable by changing the ink level 82 in the ink container 81 of the ink refilling apparatus. More particularly, the static head difference from the compressed member 52C is made equal to E for providing the above-described static negative head PE which is required at the initial pressure in the ink container. In order to accomplish this, a sensor 83 for sensing the ink level is provided at the ink level for providing E, and a cylinder 84 (ink supply means) is provided in the ink container 81 to maintain the ink level 82 at the predetermined level during ink refilling action.

The pin for the connection with the ink container is provided with a filter 64 shown in FIG. 2. The sensor 83 and the cylinder 84 (FIG. 4) may be made movable to permit air venting in the ink passage 62 so as to assure the ink fills the ink passage 62 by the capillary force.

The ink refilling apparatus of this invention is repeatedly usable. When it is not provided with the cylinder 84, it is preferable that low limit ink level sensor 89 is provided as shown in FIG. 4.

Here, the sensor 89 is provided adjacent the bottom surface of the ink containing portion 81 of the ink refilling apparatus, and is disposed above a level of an inner opening in fluid communication with the ink discharging tube. By doing so, the air is prevented from being introduced into the ink discharging tube of the ink refilling apparatus. When the sucking force of the ink container is higher than the static head difference between the inner opening of the ink containing portion of the ink refilling apparatus and the ink discharging member of the ink container, the air may be introduced in the ink container with the result of obstruction to the formation of the ink passage in the region adjacent the discharging tube. This can be avoided.

Figure 5:
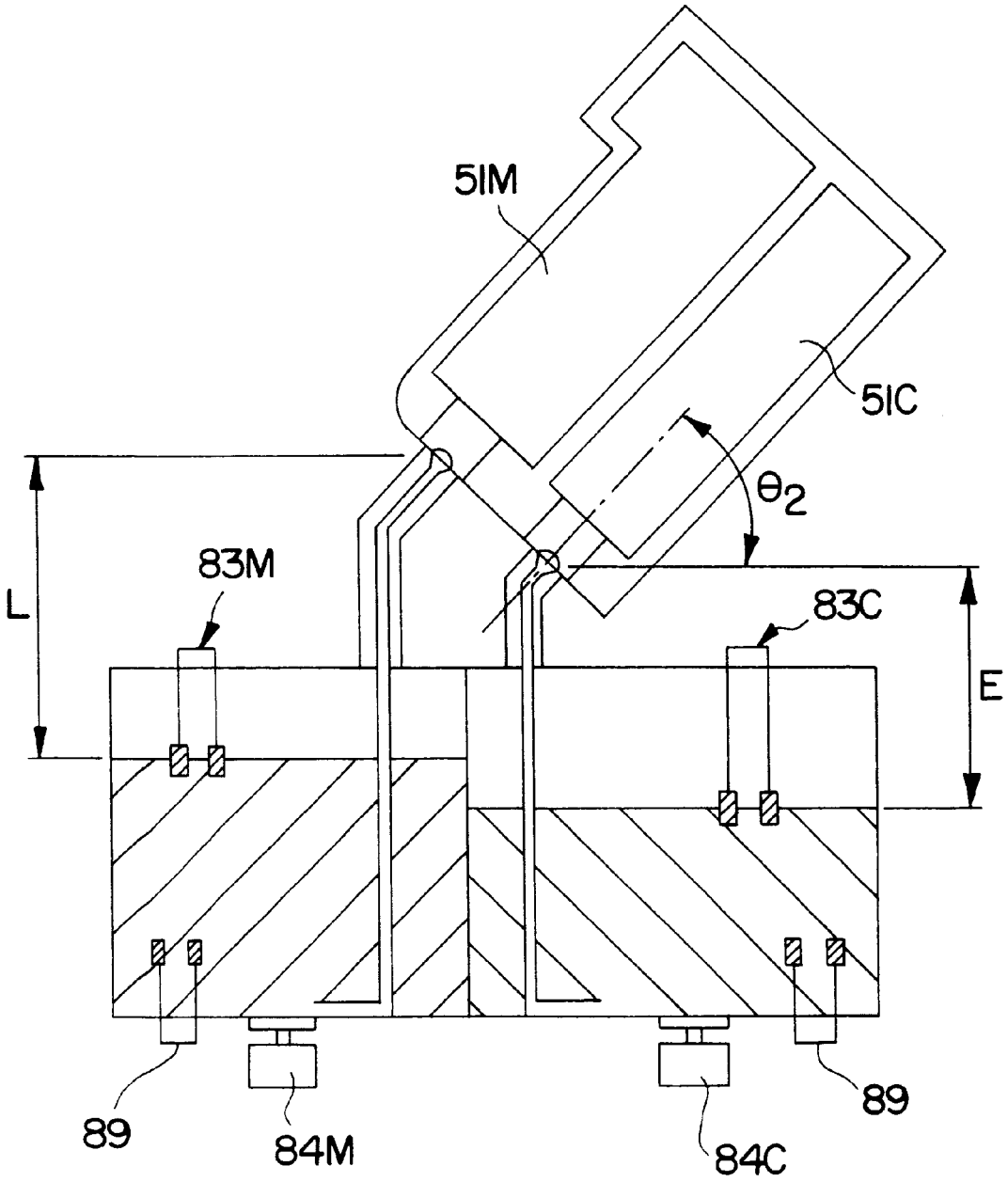
FIG. 5 is a similar sectional view in another embodiment.

In FIG. 4, the container mounting detection is perpendicular to the ink passage (θ1 is 90 degrees). When the shape of the apparatus is desired to be changed, it is possible that the ink passage 62 is vent to 82 as shown in FIG. 5. In this case, however, the static head difference E for providing the negative static pressure PL is different L for 52M while it is E in 52C. In order to make L equal to E to remove the static head difference, the sensor 83 and the cylinder 84 shown in FIG. 4 have to be divided to dispose them at different positions 83M and 83C, as shown in FIG. 5.

In consideration of the complication of the apparatus, it is preferable that the θ is 90 degrees.

From the standpoint of recent demand for high speed fixing in the ink jet printer, high seeping property of the ink is desired. Low surface tension and low viscosity ink provided by addition of surfactant is available. If it is used in the apparatus of this embodiment, the negative static pressure as its entirety shifts downwardly (FIG. 3) because of the higher seeping property into the ink retaining member with the result that the initial negative static pressure PE decreases. This decrease tends to promote movement of the ink during transportation involving vibration or pressure reduction, and therefore, the reliability decreases In order to avoid the decrease, when the high seeping property ink is used, the level E in FIG. 4 may be set at a higher level to provide the desired initial static pressure PE.

In this embodiment, the connecting pin has an ink passage 62 and a filter as shown in FIG. 2. The diameter of the ink passage may be made changeable to adjust the acting pressure of the negative static pressure PB to change the ink refilling speed. However, if the diameter is too large, the action of the weight of the ink in the diameter is too large with the result of the ink discontinuity in the ink passage without refilling up to the initial ink level. To avoid this, the preferable diameter is not more than 5 mm.

In such an apparatus, even if the degree of consumption is different for the three color inks, the ink can be supplied until the required static pressure PE is reached, if the initial levels satisfy PY=PM=PC thus providing the same static head for the respective color ink refilling devices.

Figure 6:
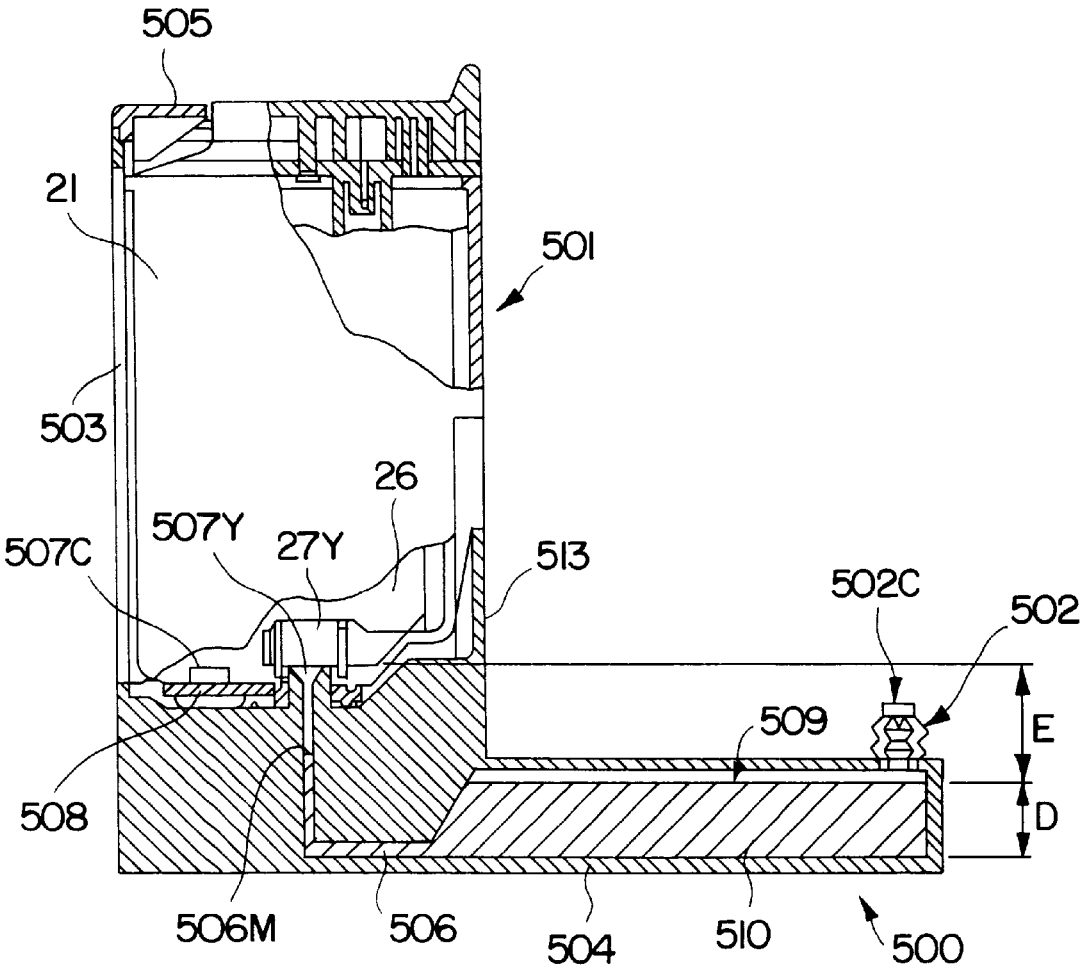
FIG. 6 is a schematic sectional view of an example of an ink refilling apparatus wherein the ink refilling apparatus and ink container are connected.

FIG. 6 shows another embodiment of the ink container refilling apparatus according to another embodiment of the present invention. In this Figure, the main assembly of the refilling apparatus 500 is mounted to an ink container 21. The holder 501 has a structure similar to the casing of the ink jet unit 101 of FIG. 8 which will be described hereinafter. It comprises a casing 503, a cover 505, a front plate 513, an ink discharging portion 507 (Y) and an elastic member 508. Positioning members or the like are provided to permit mounting and demounting of the ink container in the same or similar method as in FIG. 8.

The bottom part of the main assembly 500 is provided with an ink chamber 504, an ink discharging tube 506, a pressurizing bellows 502 (pressing means). The ink chamber contains ink 510. In this example, the description will be made as to yellow ink, but the same applies to cyan (C) ink and magenta (M) ink.

In FIG. 6, the ink container 21 is mounted. Before the mounting, the bellows 502 is provided with a rubber cap

502*c,* and a rubber cap (not shown) is mounted to the ink discharging portion 507Y, thus preventing leakage of the ink during transportation.

Figure 7:
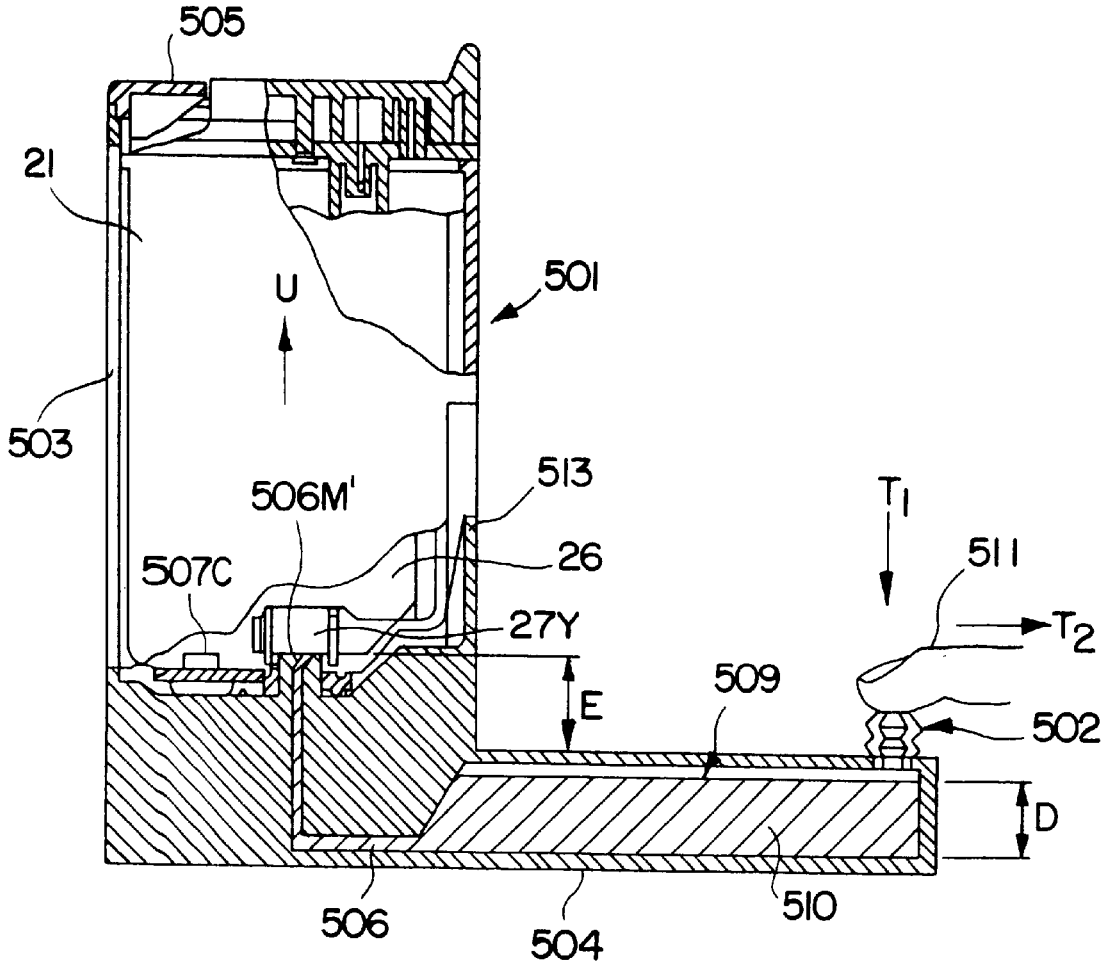
FIG. 7 illustrated the situation in which the pressure in the ink refilling container is increased in the apparatus of FIG. 6.

When the two caps are removed first, the ink meniscus 506M in the ink discharging tube 506 and the level 509 of the ink are balanced at the atmospheric pressure, and they are at the same level. When the ink container 21 which has been used up is mounted, the negative static head in the ink retaining member 26 in the used ink container 21 tends to suck the ink 510 up. However, if the meniscus 506M is formed in the ink discharging tube 506, the sucking action may be obstructed. Therefore, as shown in FIG. 7, the bellows 502 is depressed as indicated by an arrow T1 downwardly by a finger, thus pushing the meniscus 506M in the direction U to permit contact with the ink discharging member 27Y, as indicated by 506M'. By doing so, the remaining ink (not shown) in the ink container 21 and the ink 510 in the ink chamber 504 become continuous with each other.

By shifting the finger 511 in the direction T2, the air venting action instantaneously occurs. With the above-described manipulation, the ink 510 in the ink chamber 504 is assuredly sucked up by the negative static head in the ink retaining member 26 in the ink container 21. Finally, due to the characteristics of the negative static pressure peculiar to the ink retaining member 26, the ink surface 509 is away from the bottom surface of the ink discharging member 27Y by a distance E, for example 20 mm. The ink retaining member 26 is exchangeable, and can be provided with different configuration retaining members.

Referring to FIGS. 8(*a*) to FIG. (*e*), there is shown an ink jet unit 101 provided with an ink container mounting portions 110 and 111 mounted on a carriage of an ink jet recording apparatus.

As shown in FIGS. 8(*a*), (*b*) and (*c*), it comprises a casing 103 having a pair of side plates of an ink jet unit and a rear plate connecting the side plates, a front plate 113 constituting an ink containing space of the ink container between the casing 103 and a portion thereof faced to the rear plate, an intermediate plate 104 dividing the space into two spaces. The divided spaces function as a mounting portion 110 for a color ink container and a mounting portion 111 for a black ink container. The front plate 113 is approx. one third of the height of the casing 103, and the opening of the front plate 113 functions as an ink container receiving portion at which the ink container is mounted or demounted.

At an upper end of the rear plate constituting the casing 103, there is a covering portion 105 projected toward the mounting portions 110 and 111. The cover 105 functions to produce resistance against insertion when the ink container is inserted. It includes a tapered portion 105*a* inclined from the insertion side toward the mounting portions 110 and 111. The cover 105 is disposed at a position interfering with a corner of an ink container at an opposite side from an ink supply side of the ink container at the downstream of the ink insertion mounted into the mounting portion, thus increasing the feeling of the resistance by the inclined portion when it is inserted. When the corner reaches urging means 105*b* which is horizontal and which continues from the inclined portion 105*a,* the resistance is removed, thus providing the feeling of click. The urging means 105 produces force for urging the ink container mounted into the mounting portion from the top to the bottom.

The bottom of the ink jet unit 101 is provided with an ink discharging tube 107 (Y, M, C, BK, although those for M, BK are not shown) for being inserted into the ink container to introduce the inks in the ink containers to BK, C, M and Y recording heads 201 (201BK, 201C, 201M and 201Y). A predetermined length thereof is projected in the mounting portions 110 and 111 to permit insertion into the ink container.

The opening of the discharging tube 107 in the casing adjacent the mounting portion 110 for the mounting of the color ink container and black ink container, is provided with A filter 109 (Y, M, C, BK although those for M, BK are not shown) as shown in FIGS. 8(*a*) to 8(*e*) , and a predetermined length thereof is projected into the inside of the mounting portions 110 and 111 to permit insertion into the ink supply port.

Figures 8A, 8B, 8C, 8D, 8E:
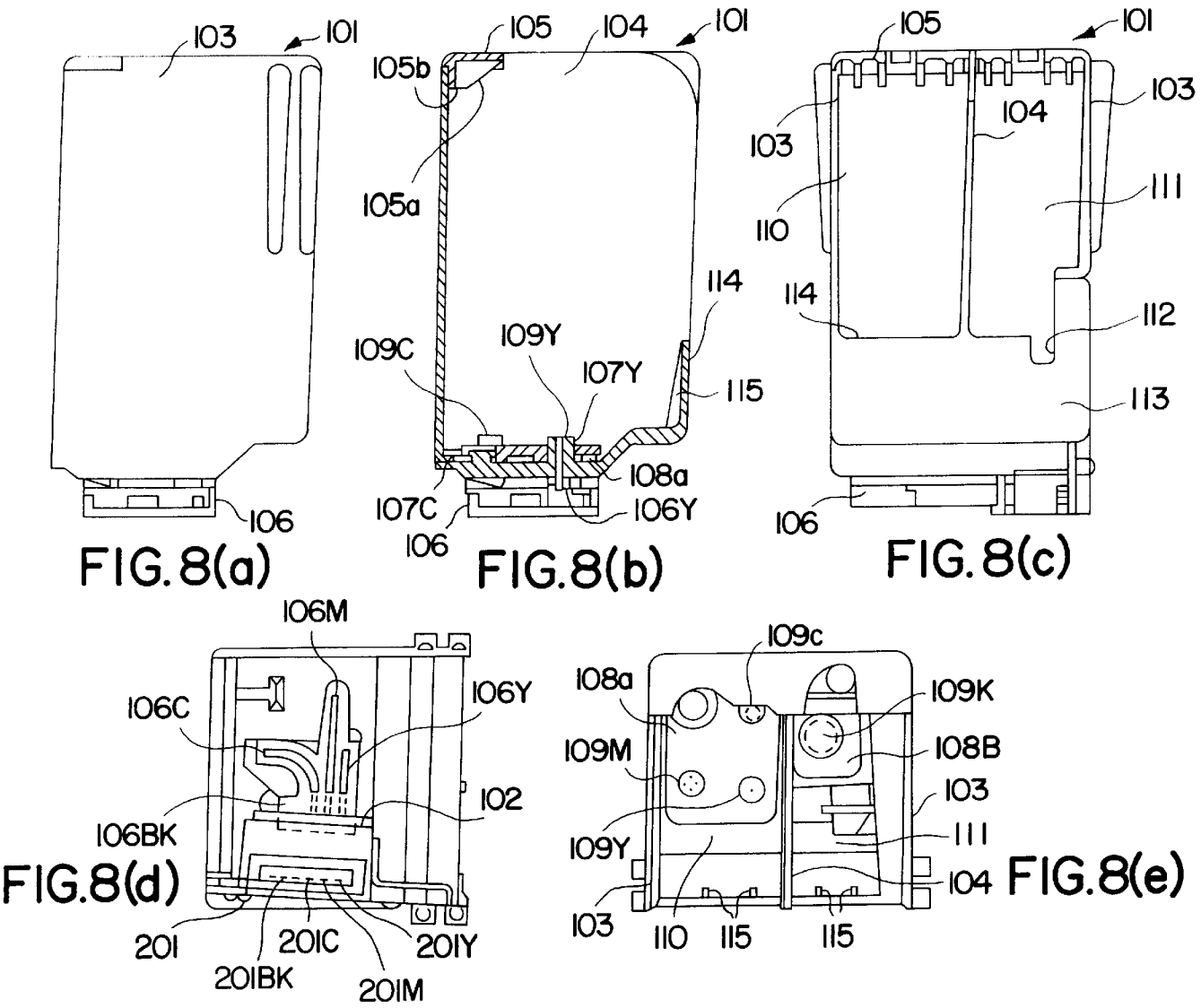
FIGS. 8(*a*) through 8(*e*) illustrate an ink jet unit to which a detachable ink container is mounted, wherein 8(*a*) is a side view, 8(*b*) is a sectional side view, 8(*c*) is a front view, 8(*d*) is a bottom view, and 8(*e*) is a top plan view.
Figure 9A:
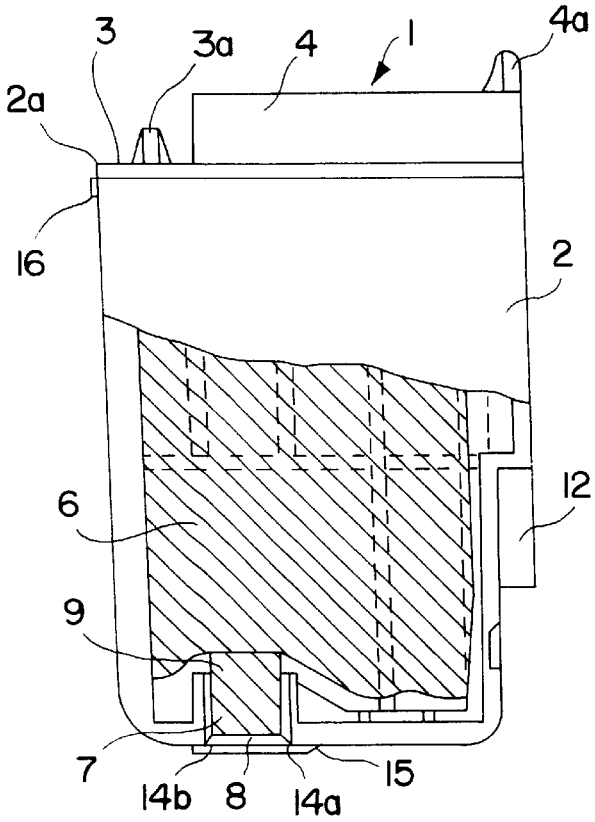
FIGS. 9(*a*) through 9(*d*) illustrate an ink container containing black ink, wherein 9(*a*) is a partly broken side sectional view, 9(*b*) is a partly broken front view, 9(*c*) is a bottom view, and 9(*d*) is a partly broken side sectional view.
Figure 9B:
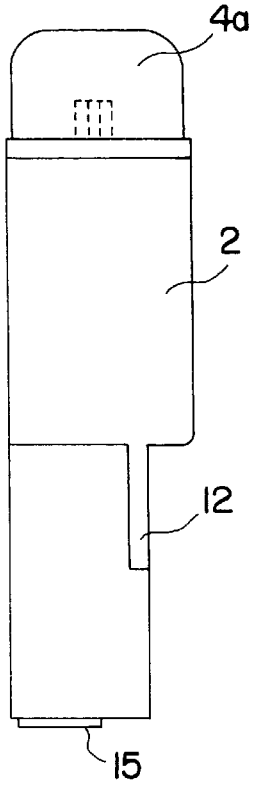
Figure 9C:
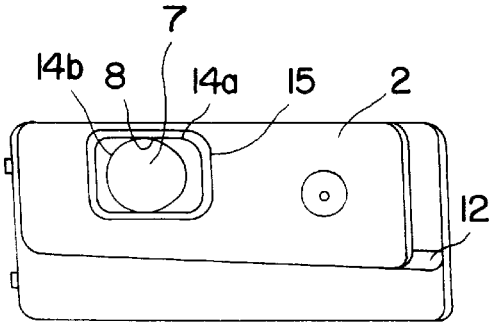
Figure 9D:
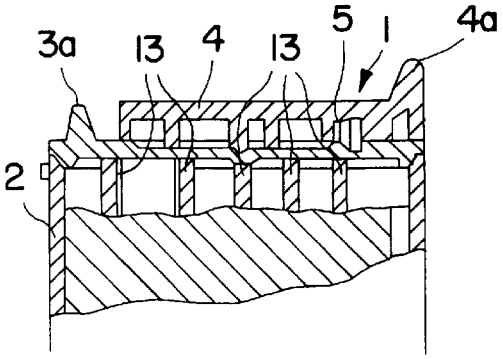
Figure 10A:
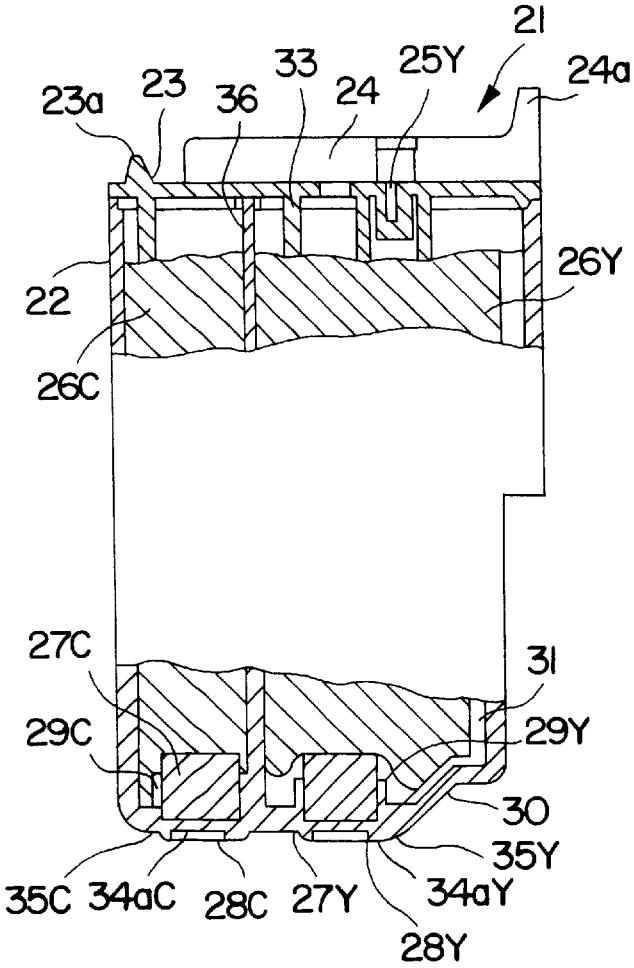
FIGS. 10(*a*) through 10(*d*) illustrate an ink container containing color (yellow, cyan, magenta) ink, wherein 10(*a*) is a partly broken side sectional view, 10(*b*) is a partly broken front view, 10(*c*) is a bottom view, and 10(*d*) is a side sectional view with the upper part omitted.
Figure 10B:
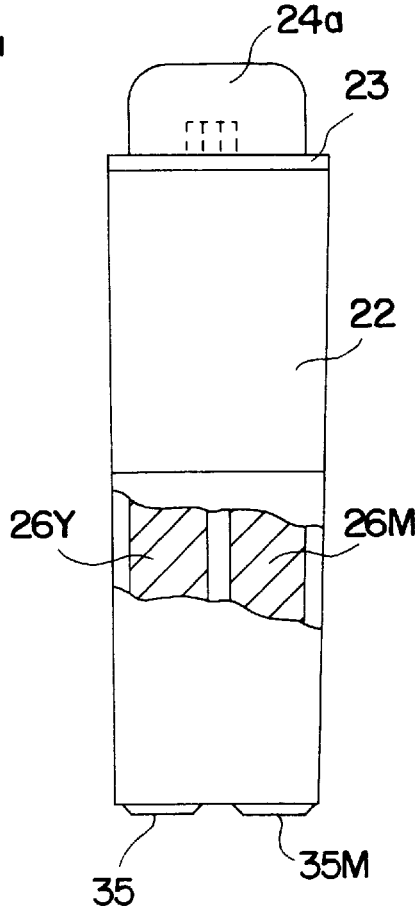
Figure 10C:
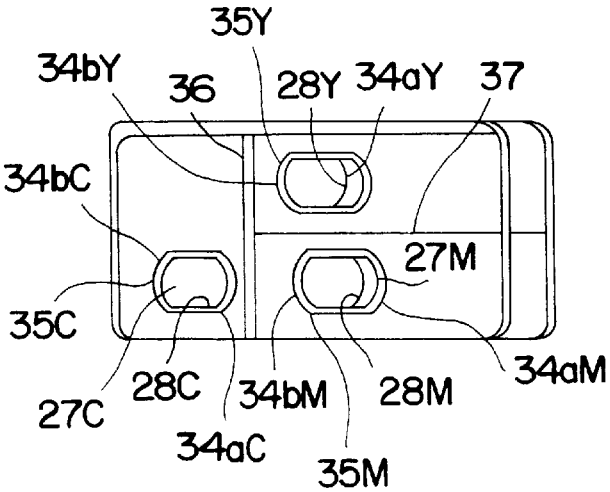
Figure 10D:
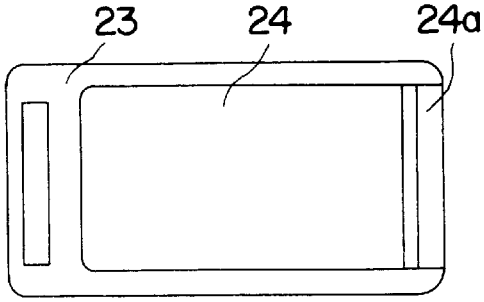

As shown in FIG. 8(d), the ink supply tube 106 (Y, M, C, BK) is provided on the bottom surface of the recording head.

On the surface on which the discharging tube 107 is disposed, an elastic plate 108*a* and 108B having a predetermined thickness is disposed around the discharging tube 107. The elastic plate 108*a* and 108B functions to prevent the ink from leaking out to the inside of the ink jet unit by a rib disposed at the ink supply port of the ink container press-contacted to the elastic plate.

As shown in FIG. 8(*c*), a cut-away portion 112 is formed in the front plate 113 at a position facing to the mounting portion 111. It can receive a rib provided in a black ink container containing black ink, by which insertion of wrong color ink container is prevented.

To the mounting portion 111 receives an ink container containing the black ink, and the mounting portion 110 receives a color ink containers containing yellow, magenta and cyan ink.

FIGS. 9(*a*) to 9(*d*) show a black ink container 1 in which FIGS. 9(*a*), (*b*), (*c*) and (*d*), are respectively a partly broken side view, a front view, a bottom view and a top sectional view.

The ink container 1 is provided with an ink containing casing 2, a cover member 3 provided with an air vent and covering the casing, an air vent having a buffering space to prevent the leaked ink from discharging through the air vent 5 and disposed at a position different from the position of the air vent 5, a top member 4 having a grip 4*a* for easy mounting and demounting relative to the ink jet unit 101.

The bottom of the ink container is provided with an ink supply opening 8 into which a discharging tube 107 (BK) of the ink jet unit 101 is inserted, a rib projected therearound, an inclined portion 14*a* and 14*b* for connection between the ink supply opening 8 and the rib 15. A rib 12 is provided on a part of a side surface having the grip 4*a*. The rib 12 cooperates with the cut-away portion 112 in the front plate 113 of the ink jet unit 101 to prevent the erroneous mounting of the ink container. The rib 12 is used also as a guide 5 mounting the ink container 1.

In this invention, the structure of the ink container is limiting. However, the present invention is particularly effective when an ink absorbing material is provided in an ink supporting portion containing elastic material.

The ink absorbing material may be of a bundle of fibers (ink discharging member), preferably.

When the ink discharging member in the form of a bundle of fibers is used, it is preferable that the bundle of fibers is press-contacted stably to the supply tube with the filter of the recording head upon the mounting and demounting of the ink container. The stability can be provided in any of embodiments of the present invention. The ink discharging member is indicated by a reference numeral 7 in FIG. 9(*a*).

In the present invention, the ink discharging member 7 disposed between the ink absorbing material 6 and the ink supply opening 8 is an ink absorbing material, and preferably, a bundle of fibers is disposed on a surface faced to the ink container. However, it may be only of ink absorbing material without the bundle of fibers. The supporting portion 9 for supporting the ink discharging member 7 in the ink container is erected corresponding to the ink supply opening 8. A part of the inside of the supporting portion 9 is provided with a slit for fluid communication between the inside and the outside of the ink container.

Here, the ink discharging member functions to supply the ink in one direction, more particularly, from the ink absorbing material to the ink supply opening 8, in this embodiment.

In this embodiment, the use is made with an ink absorbing material which is compressed and accommodated in the ink containing portion (porous ink retaining member). As the material of the ink absorbing member, sponge or the like is usable.

The ink discharging member 7 is fixed to an ink jet unit holder, and is kept press-contacted with the ink absorbing material 6 compressed and accommodated therein. Thus, it keeps the deformation of the ink absorbing material at the contact portion. By the deformation of the ink absorbing material, the capillary force is increased there, thus permitting concentration of the ink in the neighborhood of the ink discharging member 7.

By doing so, even when the recording head and the ink container are separated, the ink is always supplied to the ink discharging member, and the meniscus is formed at the ink discharging member adjacent the ink supply opening, and therefore, no air is sucked in.

When the ink passage is established by the connection of the recording head and the ink container, the flow of the ink into the ink discharging member is promoted, and the ink discontinuity is prevented, thus reducing the amount of the non-usable remaining ink, and the usage of the ink in the ink container is improved.

When the ink absorbing material is contained under the state of compression, as shown in FIGS. 9(*a*), the neighborhood of the press-contact is deformed to the largest extent thus permitting concentration of the ink to the neighborhood, since the ink absorbing material is urged to the ink discharging member even if the ink discharging member is press-contacted to the ink absorbing material as shown in FIG. 9(*a*).

When the degree of compression of the ink absorbing material when it is compressed and accommodated is not proper or when the ink absorbing material has a low elastic coefficient, the ink discharging member is press fitted into the ink absorbing material to assure the deformation of the ink absorbing material, thus assuring the concentration of the ink there, preferably.

Here, the press-fitting means insertion of the ink discharging member into the ink absorbing material with the force higher than the force under normal operation, thus assuring the press-contact.

Generally, in an ink jet recording apparatus, ejecting portion is maintained at a proper level to prevent ink leakage through the ejection outlet of the recording head and deterioration of the printing quality attributable to the improper ink supply to the ejecting portion. In order to stabilize the performance of the ink jet recording head, it is negative (generally 0 to −150 mmAq, further preferably −30 to −100 mmAq on the basis of the atmospheric pressure). The negative pressure in this embodiment is a back pressure in the ink supply movement from the ink container to the recording head, and particularly, it is a negative pressure to provide a pressure lower than the atmospheric pressure in the recording head.

By the connection between the ink jet recording head and the ink container, the filter of the ink jet recording head is closely contacted with a predetermined pressure with the ink discharging member.

The urging force depends on a degree of protection of the ink introducing portion of the recording head, and a distance from the outer surface of the ink container abutted to the recording head to the contact plane between the ink introducing portion and an ink discharging member contacted thereto, that is, the depth of the ink supply opening.

By this connection, an ink passage is established to supply the ink from the porous material in the ink container to the ink introducing portion of the recording head through an ink discharging member to permit supply of the ink to the recording head.

The O-ring may be provided between the recording head and the ink container to provide a sealed state of the ink passage constituted by the connection between the ink introduction portion and the ink supply opening. The leakage of the ink at the connecting portion is prevented, and minimize the evaporation of the ink.

The ink discharging member 7 is of a bundle of fibers, and the usable materials include polyester, nylon, polypropylene, polyethylene, cellulose, polyurethane or the like. Particularly, the material exhibits stability against chemical reaction, and exhibits high wettability.

The high wettability is provided by small contact angle of the ink, generally. The Teflon or the like material having a large contact angle is usable if it is treated for hydrophilic property. However, the small contact angle material is preferable from the standpoint of the number of manufacturing steps, the increase of the manufacturing cost.

As for the other fibrous material, metal, glass, carbon fibers are usable, or the fibrous materials described above may be mixed therewith.

Since the ink discharging member constitutes a part of the ink passage, it has a directional property for the ink movement. Since it is press-contacted to the introduction portion of the recording head, it has a substantial degree of mechanical strength to maintain the configuration thereof. For this reason, it is desirable a bundle of fibers.

The upper limit of the size of the fibers constituting the ink discharging member is the contactness between the ink discharging member and the filter provided in the ink introducing portion. From this standpoint, it is preferably 0.05 mm or smaller. As to the lower limit of the thickness of the fiber, it is preferably not less than 0.01 mm to facilitate formation of the bundle of fibers since the fibers are made dense by the ink discharging member.

As means for binding the fibers, the use can be made with resin binder to cure the outer circumference of the bundle of the fibers, by doing so, a cured area is formed adjacent the outer periphery of the ink discharging member.

As a resin material applied to the outer periphery of the bundle of fibers, polyester polyol polyurethane, or melamine binder if it is matched with the intention, are usable.

As a means for forming the cured region for constituting the bundle of fibers, they may be fused by heat or pressure applied from the outer side. The fibers may be bound by another member without formation of the cured region. However, when the cured region is formed, the binder can be impregnated simultaneously with the molding. When the fibers are covered or bound, the binding operation or the like has to be carried out while the fibers are tentatively bound. Therefore, manufacturing complication is liable to occur to provide uniform strength. For this reason, the formation of the cured region is desirable.

As to the formation of the bundle of fibers, it is not limited to the structures or methods described above if the direction of the ink supply can be maintained, and the ink supply is not disabled or is not made non-uniform by deformation of the fibers upon the press-contact with the ink introducing part of the recording head. As shown in FIG. 9(*d*), the top member 4 is provided with a rib 13 to provide a predetermined gap between the ink absorbing material 6 and the top member 4. The front side of the cover member 3 is provided with a projection 3*a* in the form of a rib.

A corner 2*a* of the ink container is engaged with the above-described tapered portion 105*a* provided in the cover 105 on the ink jet unit 101. The dimensions of the ink container are determined so that the resistance of insertion is gradually increased upon the insertion of the ink container. With further insertion, it is engaged with an urging means 105*b* on the cover 105 so that the inserting resistance is instantaneously removed, and therefore, the user feels click, thus assuring the manual insertion. Additionally, the urging means 105*b* applies the force in the direction from the top to the bottom to the ink container 1, thus stabilizing the mounting of the ink container.

The projection 3*a* is engaged with an engaging portion 105*c* provided at a position which is different from a position of inclination 105*a* of the cover 105 described above, thus maintaining the engagement upon the mounting operation.

The significance of the effect of the assured insertion feeling with the small space is provided by the configurations and positions of the urging means from and the inclined portion 105*a* of the cover 105, longitudinal and lateral dimensional relationship of the ink container, and the engaging portion.

The internal surface of the ink container is provided with a plurality of ribs 13 extended vertically, and a predetermined space is formed between the size of the ink container and the ink absorbing material.

In the ink container 1, the ink supply opening 8 is displaced toward one side of the bottom surface of the ink, as shown in FIG. 9(*c*). Therefore, the ink absorbing material tends to be deposited without gap against the bottom surface of the ink container. If the ink absorbing material is contacted to the bottom surface of the ink container without the gap, the ink tends to be stagnated there with the result of ink leakage through the air vent or through the ink supply opening, depending on the pose or attitude of the ink container. In order to avoid the inconveniences, the bottom of the ink container is provided with the ribs, thus preventing contact of the ink absorbing material to the bottom of the ink container.

In this manner, the ribs are provided in the inside of the ink container, and the slit is formed in the supporting portion 9, and therefore, the ink supply opening 8 and the air vent opening 5 are in fluid communication by a layer of air.

By the fluid communication through the air layer between the inside of the ink container and the outside is effective to:

Ink discharge or leakage through the ink supply opening can be prevented upon removal of a sealing member for sealing the ink supply opening during the transportation of the ink container;

To prevent pushing the ink out upon increase of the temperature around the ink container during printing operation; and To prevent stagnation of the ink on the bottom of the ink container, thus improving the ink consumption efficiency.

The ink container 1 has a small bottom area by reducing the projection area relative to the recording head, while maintaining the ink accommodation capacity. This is accomplished by increasing the height of the ink container (high aspect ratio).

In addition, the ink container 1 has a stepped portion in the middle to increase the ink accommodating capacity. Additionally, when the ink container is mounted into the casing 103, the stepped portion provides the feeling of integrity as an ink jet unit.

The outside dimensions of the ink container 1 excluding the top member 4 are: approx. 51.4 mm in height, approx. 38.4 mm in the depth at the top portion, approx. 34.9 mm in the depth at the bottom, approx. 2.7 mm in the depth of the rib 12, approx. 16.9 mm in the top width, approx. 11.1 mm in the bottom width, and approx. 24.4 mm in the height from the stepped portion to the bottom. Therefore, the ink container slightly expands from the bottom to the top. The stepped portion is at ½ level between the top and the bottom.

As shown in FIGS. 10(*a*), (*b*), (*c*) and (*d*), a color ink container 21 containing color inks (yellow, cyan, magenta) is an integral container containing all of these inks.

As shown in FIG. 10(*c*), the color ink container 21 is partitioned by T-like partition member 36 and 37 in the inside of the ink accommodating casing 22. The quantities of the color inks contains in the respective chambers are substantially equal. By dividing the inside in this manner, the ink supply port can be concentrated in the region adjacent to the ink accommodating portion, as shown in FIG. 10(*c*).

By this partition and by the concentration of the ink supply openings in the region, the space required for connection with the recording head can be reduced to a great extend, and simultaneously, the projection area of the ink container can be reduced. In other words, the ink capacity is large in consideration of the projection area and the space required for the connection.

The dimensions of the ink container 21 except the top member 24, are as follows: approx. 56.5 mm in height, approx. 38.4 mm in top depth, approx. 31.5 mm in the bottom depth (approx. 34.5 mm in the depth in the middle portion), approx. 19.3 mm in the top width, approx. 18.1 mm in the bottom width, approx. 29.5 mm in the height from the bottom to the stepped portion of the container. The stepped portion between the top and the bottom is substantially ½ height.

The other major structure of the ink container is substantially the same as in the ink container 1. The ink container 21 comprises an ink accommodating casing 23, a cover member 23 for covering the casing 22 and provided with air vent opening 25 (Y, M, C, although those for M and C are not shown), a buffer chamber for preventing ink leaked through the air venting passage 25 from leaking out, an air vent provided at a position from that of the air venting passage 25, and a top member 24 having a grip 24 for facilitating mounting and demounting manipulation of the ink jet unit 101.

The bottom of the ink container is provided with an ink supply opening 28 (Y, X, C) for receiving an ink discharging tube 107 (Y, M, C) of the ink jet unit 101, a rib 35 (Y, M, C) projected therearound, an inclined portion 34*a* (Y, M, C) for connecting the ink supply opening 28 (Y, M, C) and the rib 35 (Y, M, C). The ink container 21 is mounted to the ink jet unit 101 with rotational motion, as will be described hereinafter. In order to permit smooth mounting operation without abutment between the ink supply opening 28 (Y, M, C) and the end edge of the discharging tube 107, the side 34*a* (Y, M, C) is slightly inclined. Particularly for the yellow container portion and the magenta container portion into which the discharging portions 107 first enter by the rotational motion, the inclinations of the ink supply opening 28 (Y, M) are smaller than in the cyan container portion.

By using smaller inclination at the upstream side of the inserting rotation of the ink container, the ink supply opening 28 (Y, M, C) during the rotating motion is prevented from abutment with the discharging tube 107 (Y, M, C), while smooth rotating insertion can be accomplished with small space. Additionally, as will be described hereinafter, the sliding motion of the ink container toward the upstream in the inserting direction at the bottom of the casing immediately before the completion of the insertion, is smooth, as will be described hereinafter.

The inside of the ink container 21, as shown in FIG. 9(*a*), contains the ink absorbing material 26 (Y, M, C). Between the ink absorbing material 26 (Y, M, C) and the ink supply opening 28 (Y, M, C), the ink discharging member 27 (Y, M, C) is provided. A slit for fluid communication between the inside of the ink container and the outside thereof is formed in a part of the inside wall of the supporting member 29 (Y, M, C) for maintaining the ink discharging member 27 (Y, M, C) in the ink container.

The cover member 23 is provided with a rib 33 for providing a predetermined gap between the ink absorbing material and the cover member 23, and a projection 23*a* in the form of a stripe on the front side of the cover member 23. The projection 23*a* is engageable with the cover 105 of the ink jet unit 101 to apply the ink container 21 the force in the direction from the top to the bottom, thus stabilizing the mounting of the ink container.

The internal surface of the ink container is provided with a plurality of ribs 13 extended vertically, and a predetermined space is formed between the size of the ink container and the ink absorbing material.

In the ink container 21, the ink supply opening 28 is displaced toward one side of the bottom surface of the ink, as shown in FIG. 10(*c*). Therefore, the ink absorbing material tends to be deposited without gap against the bottom surface of the ink container. If the ink absorbing material is contacted to the bottom surface of the ink container without the gap, the ink tends to be stagnated there with the result of ink leakage through the air vent or through the ink supply opening, depending on the pose or attitude of the ink container. In order to avoid the inconveniences, the bottom of the ink container 21 is provided with the ribs 30, thus preventing contact of the ink absorbing material to the bottom of the ink container.

In this manner, the ribs 30 and 31 are provided in the inside of the ink container, and the slit 29 is formed in the supporting portion 29, and therefore, the ink supply opening 28 and the air vent opening 25 are in fluid communication by a layer of air.

By the fluid communication through the air layer between the inside of the ink container and the outside is effective to:

Ink discharge or leakage through the ink supply opening can be prevented upon removal of a sealing member for sealing the ink supply opening during the transportation of the ink container;

To prevent pushing the ink out upon increase of the temperature around the ink container during printing operation; and To prevent stagnation of the ink on the bottom of the ink container, thus improving the ink consumption efficiency.

The refilling method and apparatus of this invention is usable with the case in which the ink container contains three color inks, and has openings for insertion of connecting tubes to discharge the three color inks on the same plans (holder connecting plane), and the inks are present between the opening and the ink retaining member and in the ink retaining member (ink absorbing material), and the ink is contained in the another ink absorbing material (ink discharging member) having larger capillary force than the ink retaining member. In this case, the ink retaining capacities of the ink retaining members and the ink absorbing members may be different, and the dimensions of the ink retaining members may be different. Furthermore, the ink consumption may be different. Even in such cases, the refilling method and apparatus of this embodiment is usable, and the respective quantities of the inks in the ink container after the refilling can be made substantially equal to those before the start of the use.

Even if only one color ink is used up, all of the quantities of the different color inks after the completion of the refilling are substantially the same as the quantities before the start of use, without overcharging the other color inks.

Figure 11:
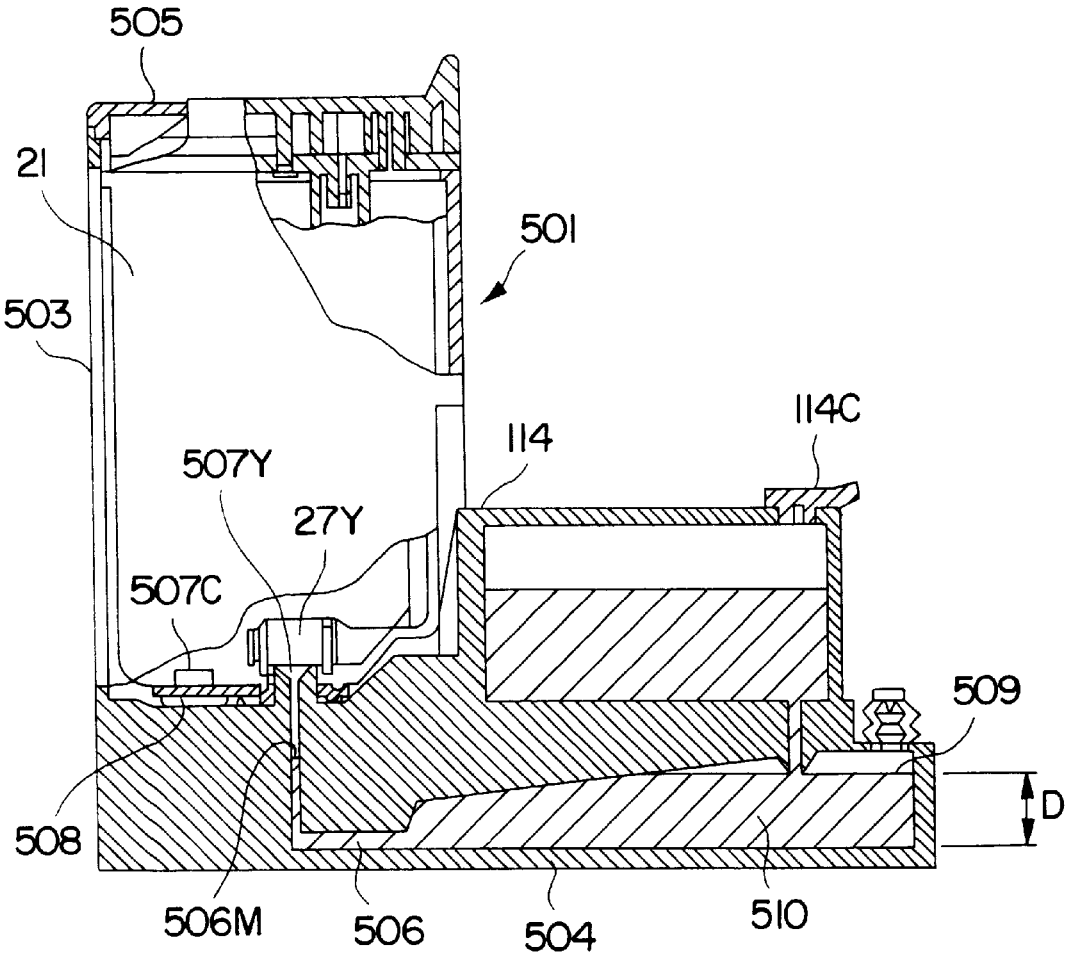
FIG. 11 is a schematic sectional view illustrating an ink refilling method according to a further embodiment, which uses chicken-feed system.
Figure 12:
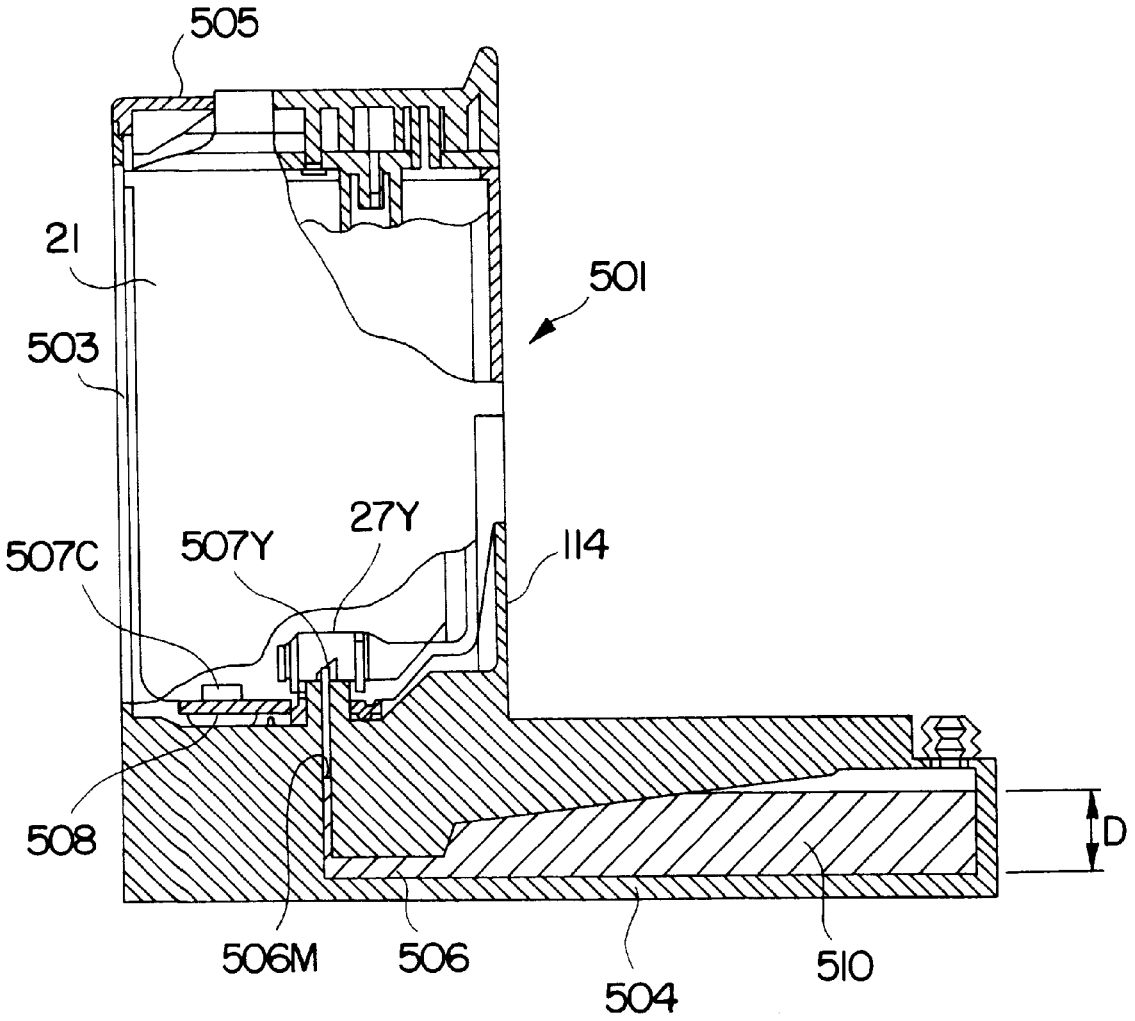
FIG. 12 is a schematic sectional view illustrating another embodiment.
Figure 13:
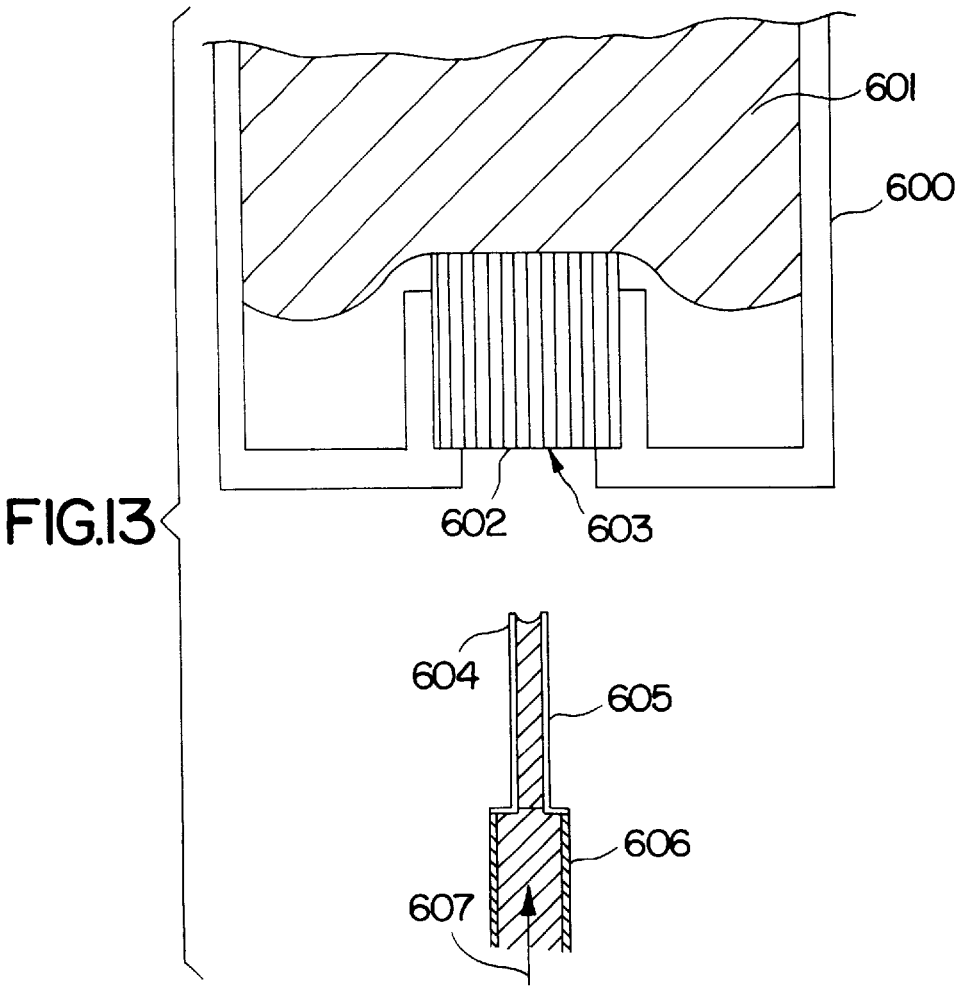
FIG. 13 is a sectional view illustrating a further embodiment.
Figure 14:
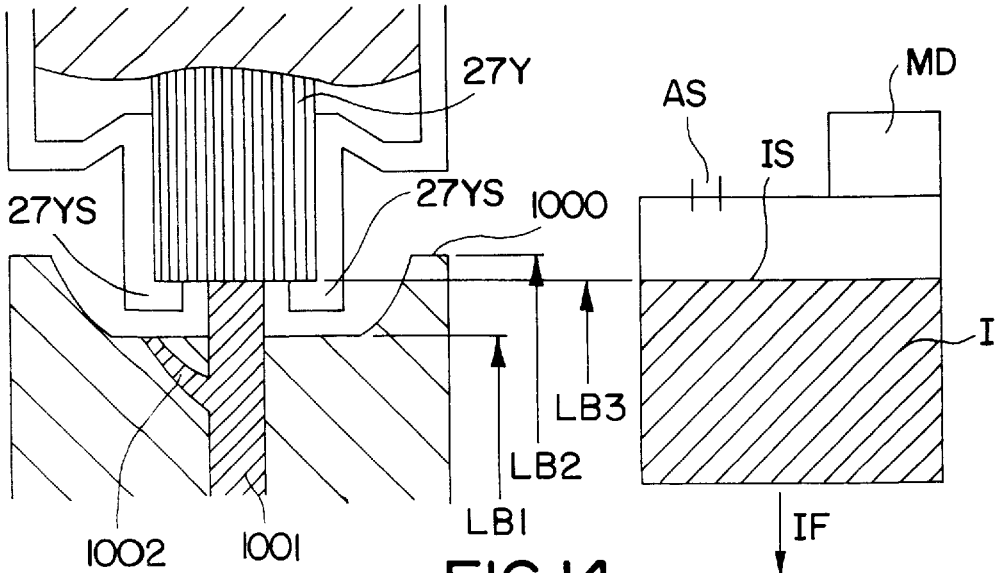
FIG. 14 is a schematic sectional view illustrating another embodiment of the ink refilling method, wherein the initial ink level is equivalent to the level in the ink refilling portion of the ink container.
Figure 15:
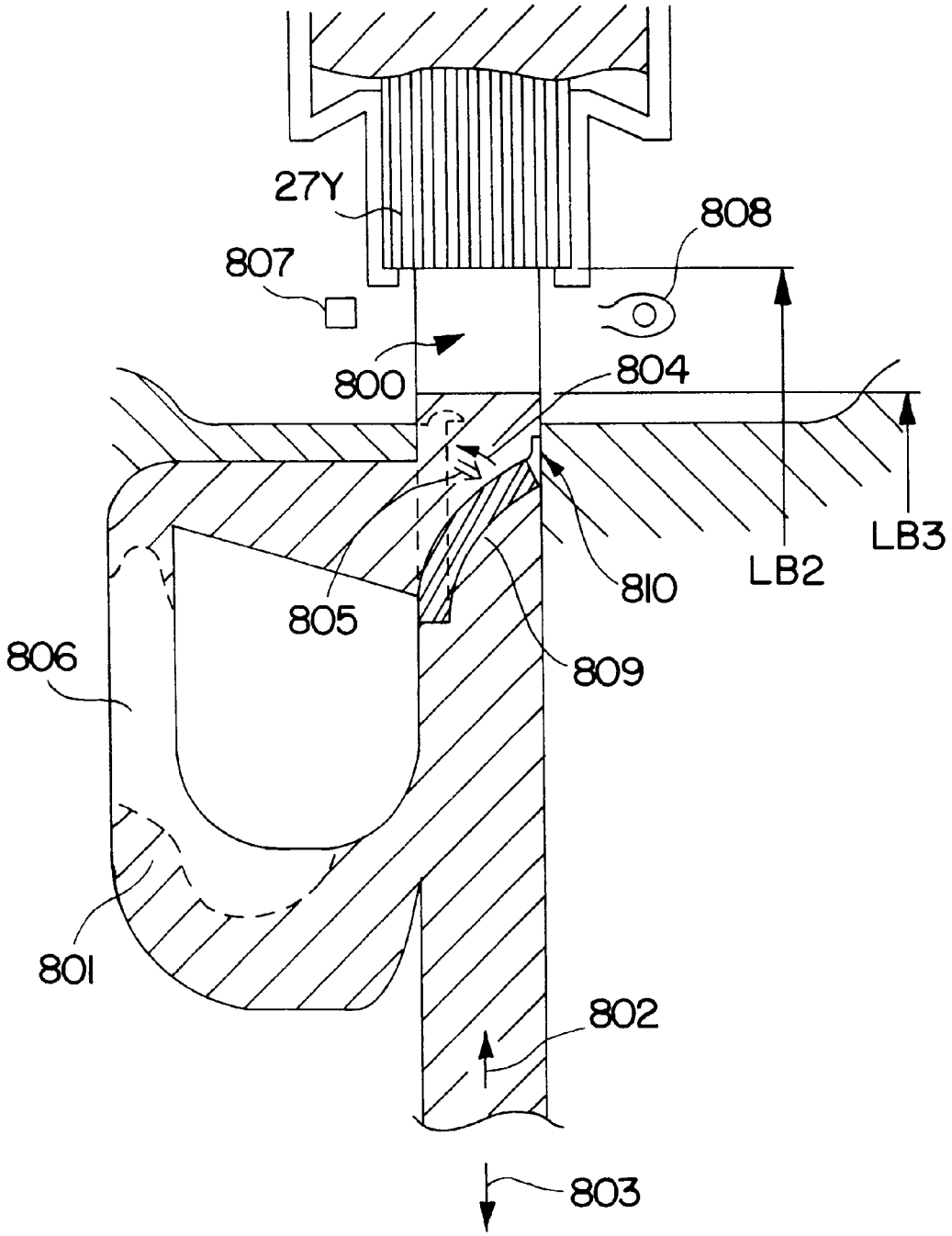
FIG. 15 is a sectional view illustrating an ink refilling method according to a further embodiment.

FIGS. 11–15 show modified embodiment of FIGS. 6 and 7. FIG. 11 illustrates a chicken-feed type embodiment in which the ink level in the ink refilling apparatus is maintained at a substantially constant level. FIG. 12 illustrates a modified example in which ink meniscus breaking step in the ink container is used. FIG. 13 is a modification of FIG. 12 embodiment. FIG. 14 illustrates an embodiment in which at least the initial ink level of the ink refilling apparatus is made equivalent to the level of the ink refilling portion of the ink container. In FIG. 15, the ink meniscus is broken by sucking using remaining ink in the ink container, and the detection of presence or absence of the gas (air) is used for the discrimination of the completion of the ink refilling.

The ink refilling method and apparatus of FIG. 11 is similar to that of FIGS. 6 and 7, and therefore, only the different portions will be described.

The ink chamber 504 of FIG. 11 is provided with a refilling ink container portion such that an end of the ink supply tube of the refilling ink container of the chicken-feed type to the ink surface 509 of the ink. The refilling ink container portion has an opening which is opened upon the ink filling at the top. The opening in closed by a gap 114C when the ink is to be refilled. When the ink in the ink chamber 504 is consumed for the ink refilling, the ink level 509 slightly lowers, and is departed from the end of the ink supply tube of the ink container. At this time, the end of the supply tube is contacted to the ambient air to take the ambient air into the ink container so as to permit the ink flows from the ink container to increase the ink surface 509. By this rising, the ink level surface 509 is contacted to the end of the supply tube, by which the introduction of the air into the supply tube is stopped, so that the liquid level of the ink 509 can be maintained substantially constant. Accordingly, according to this embodiment, there is no need of provision of the level sensor (it is preferable to provide a structure for avoiding that the remaining amount of the ink in the ink container is 0). The static head difference upon the completion of the ink refilling, as described in FIGS. 4 and 5, can be assured. Additionally, the static head difference relative to the ink container 21 during the ink refilling operation can be made constant, and therefore, the ink refilling conditions can be maintained constant. In other words, the quantity of the ink refilling in accordance with the negative pressure produced by the ink consumption in the ink container 21, can be assuredly provided.

Referring to FIG. 12, the structure is similar to FIGS. 6 and 7. However, it is different in that the ink discharging portion 507Y is mechanically inserted into the ink discharging member 27Y of the ink container to be refilled. The ink discharging portion 507Y of this embodiment is capable of break the meniscus mechanically at least a part thereof prior to the meniscus breaking step using the pressurized ink described hereinbefore by the remaining ink in the ink discharging member 27Y. By doing so, the ink filling efficiency into the ink discharging member 27Y can be increased. Even if there is air between the in surface 509 and the end of the ink discharging portion 507Y, the air can be assuredly discharged into the ink inside, thus stabilizing the action of the ink refilling by the negative pressure.

FIG. 13 shows a major part of the modification of FIG. 12 embodiment in which the ink discharging portion 507Y is modified. No pressurization or sucking (which will be described hereinafter) or another external force is reabsorbed.

In FIG. 13, an ink container 600 to be refilled has a porous member 601 producing negative static head due to the ink consumption (one side is 4 times compressed as compared with the configuration before the insertion to the container 600), and an ink discharging member 602 having an ink supply direction during the recording which is the same as the direction of the gravity and which is an ink absorbing portion of the ink container, press-contacted.

The ink supply tube 606 has the ink discharging portion contacted to the ink discharging member 602 is capable of effecting the ink refilling in the direction 607 by the contact. The supply tube 606 contains at the end thereof rods 604 and 605 having a small diameter or width (not more than 1 mm) with small gap therebetween (not more than 1 mm, preferably approx. 500 $\mu$m). The base ends of the rod 604 and 605 are contacted to the ink in the supply tube 606, and between the rods 604 and 605, there is ink raised from the end of the supply tube 606 by the surface tension to retain a small amount of ink at the ends of the rods 604 and 605.

When the rods 604 and 605 are inserted into the ink discharging member 602 has the ink receptor of the ink container to be refilled, it breaks mechanically the ink meniscus of the ink discharging member 602, and simultaneously therewith, the fluid communication is established between the ink to be refilled and the remaining amount of the ink in the ink container. Therefore, the ink retains in the ink refilling apparatus is assuredly supplied through the ink discharging member 602 into the porous materials 601 of the ink container by the negative pressure produced in the ink container by the consumption of the ink through the ink supply tube 606, by the mounting of the ink container.

The FIG. 13 embodiment eliminates the necessity for the use of the above-described pressure means, and therefore, the operation of the user is simple.

In FIG. 14, the positional level LB3 of the ink surface IS in the ink refilling apparatus is made equivalent to the level LE3 of the ink absorbing portion in the ink container, and the position of the end of the ink discharging portion 1001 is the same. The right ink chamber is connected with the left ink discharging portion 1001 through an ink supply passage IS (not shown), and it comprises a pressurizing means MD for breaking the ink meniscus by plugging the air vent portion AS during the operation. The level LB3 of the ink level IS is maintained constant upon the start of the refilling. The end of the ink discharging portion 1001 is provided with a recess for receiving a relatively projected portion for supporting the ink discharging member 27Y of the ink container, therearound. Further outside thereof is provided with an outer wall 1000 at a level LB2 higher than the level LB3. The outer wall 1000 has a wall function to prevent the leakage of the ink over the outer wall into the recessed region faced to a stopper 27YS for supporting the ink discharging member 27Y. The ink discharging portion 1001 has a branch 1002 in fluid communication with the recess. In the ink meniscus breaking step in this embodiment, the pressurizing means MD is operated to break, by the pressurized ink, the meniscus of the ink discharging member 27Y directly contacted to the ink in the ink discharging portion 1001. At this time, even if the ink overflows by a plurality of pressurizations, the ink is collected in the recess, and the ink is collected so as not to raise the ink level beyond the level LB3 through the branch 1002. The level of the end of the branch 1002 relative to the recess and the level of the recess region, are below the level LB3 of the ink liquid level IS.

Accordingly, in the initial stage of the refilling operation, the ink meniscus is broken not through the air existing due to the difference of the positional level. Thereafter, the ink is refilled by the negative pressure in the ink container. The ink level IS lowers with the filling of the ink during the refilling operation (the air vent passage AS is opened). Therefore, upon the completion of the refilling operation, the ink is not retained in the recess, so that the ink is not deposited on the stopper 20YS of the ink container.

In this embodiment, the liquid level controls described in conjunction with FIGS. 4 and 5, can be incorporated, desirably.

FIG. 15 shows an embodiment in which, as contrasted to the FIG. 14 embodiment, the air in the ink supply passage introduced by the difference between the refilling ink level LB3 and the level LB2 of the ink absorbing portion of the ink container to be refilled, is used as the discrimination of the completion of the meniscus breaking step and the completion of the ink refilling.

In FIG. 15, designated by 800 is the air existing in the ink supply passage by the level difference. It is contacted to the ink discharging member 27Y at the ink absorbing portion of the ink container. The ink discharging portion at the ink refilling apparatus side has a by-pass passage 801 in the form of "C" relative to the ink refilling passage extending upwardly. In order to detect the presence to absence of the air 800 adjacent the ink discharging member 27Y, a light emitting element 803 and a light refilling element 807 are faced as shown in the Figure with the light transmitting ink passage area.

In the top connecting portion between the ink refilling passage and the by-pass 801, there is provided a valve 809 having a small gravity (easy to float) as compared with the ink to shut-off the top connecting portion. The valve is movable toward the ink supply passage. The valve 809 is fixed at its one end as shown in the Figure, and has a projection 810 projecting toward the ink supply passage, adjacent the other end. The projection 810 receives an attraction force to move the valve 809 by the sucking action which will be described, at a position for shutting the ink supply passage, thus facilitating the motion of the valve.

The ink refilling passage is provided with unshown sucking means for sucking the ink in the direction of an arrow 803. Below the C-like by-pass passage, there is a U-shaped passage temporarily accumulating the air 800. As indicated by the broken line 806, the air 800 is temporarily exhausted from the ink refilling passage.

Upon the start of the ink refilling, the air 800 at the position indicated in the Figure, is sucked by the sucking means, and simultaneously, the valve 809 at the broken line position moves in the direction indicated by an arrow 805 by the sucking force applies to the projection 810. Simultaneously, the ink meniscus breaking is carried out by the sucking from the ink discharging member 27Y of the ink container. At this time, the valve 809 closes the refilling ink supply passage, as shown in the Figure. Therefore, the air 800 moves to the by-pass passage 801, and the ink from the ink container fills the upper end portion of the ink refilling passage. By doing so, the light emitting element 808 and the light receiving element 807 detects the existence of the ink in the light transmitting zone, and therefore, the completion of the air 800 exhausting can be discriminated. It is preferable to adjust the amount of the received light depending on the color of the ink. On the basis of the result of the discrimination, the sucking of the sucking means is stopped, and the ink in the ink refilling apparatus is opened to the atmospheric pressure (not shown). By this step, the negative pressure produced by the consumption of the ink in the ink container starts to the ink refilling. Since the sucking force of the valve 809 is removed so that the valve 809 floats by the negative sucking force from the inside of the ink container during the refilling and the flow of the ink with the aid of the difference in the specific gravities, thus closing the top end of the by-pass passage. Therefore, the air 806 in the by-pass passage is maintained during the refilling operation. In other words, during the ink refilling operation, the air existing due to the difference of the levels is removed from the ink refilling passage. Upon stagnating the air in the by-pass passage, it is preferable that the inside diameter of the by-pass passage is smaller than the inside diameter of the ink refilling passage to provide flow resistance difference to accumulate the air in the by-pass passage. By doing so, the reliability can be improved.

Upon the completion of the refilling operation by the negative pressure of the ink container thereafter, the motion of the ink into the ink container stops to reach a balanced state. Then, the air 806 in the by-pass passage 801 rises, and the closing force of the valve 809 to the by-pass passage 801 disappears to start to float on the ink. Therefore, the air 806 returns to the initial position above the connecting portion as indicated in the Figure. By this, the ink in the ink refilling apparatus departs the ink container to discontinue the ink, and the amount of the light received by the light receiving element 807 increases. With this state, even if the ink container is removed, no ink contamination occurs, and the ink refilling is completed without overcharge. Therefore, by the discrimination using the light receiving element, namely, the discrimination of the returning of the air 800, the completion of the ink refilling can be discriminated. In this embodiment, in response to the detection of the returning of the air 800 by the light receiving element, the completion of the ink refilling is notified to the user (known means for the notification is usable). Other method of detecting existing of the air 800 is usable with this embodiment.

According to the embodiment of FIG. 15, the operator can refill the ink by simply mounting the ink container. It is preferable that the structure shown in FIGS. 6 and 7 is used, and it is also preferable to use a mechanism for positioning the ink container for the recording operation. The automatic ink refilling mechanism is accomplished, and the operator is promoted by the above notification to remove the ink container.

In the foregoing embodiments, the ink container to be refilled may be a single color ink container, and the ink absorbing member may be one or more.

As described, according to these embodiments, the ink can be refilled into the ink container which is exchangeably mountable to an ink jet unit by a simple structure without use of needles or the like, without ink leakage and without binding the user for a long period.

Figures 16A, 16B:
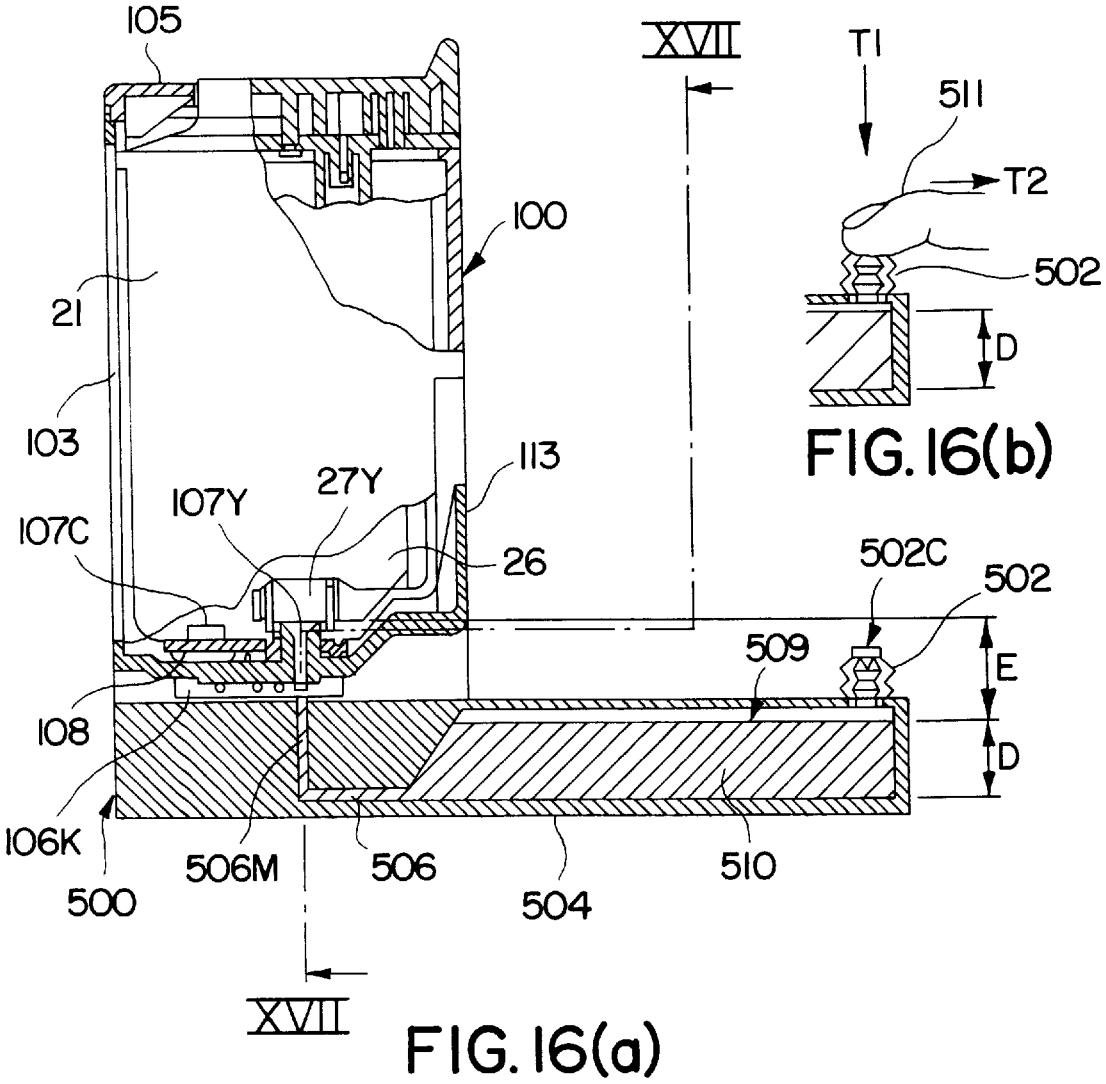
FIGS. 16(*a*) and 16(*b*) are schematic sectional views illustrating an ink refilling method according to a further embodiment, in which the ink refilling apparatus is connected with the ink container.
Figure 17:
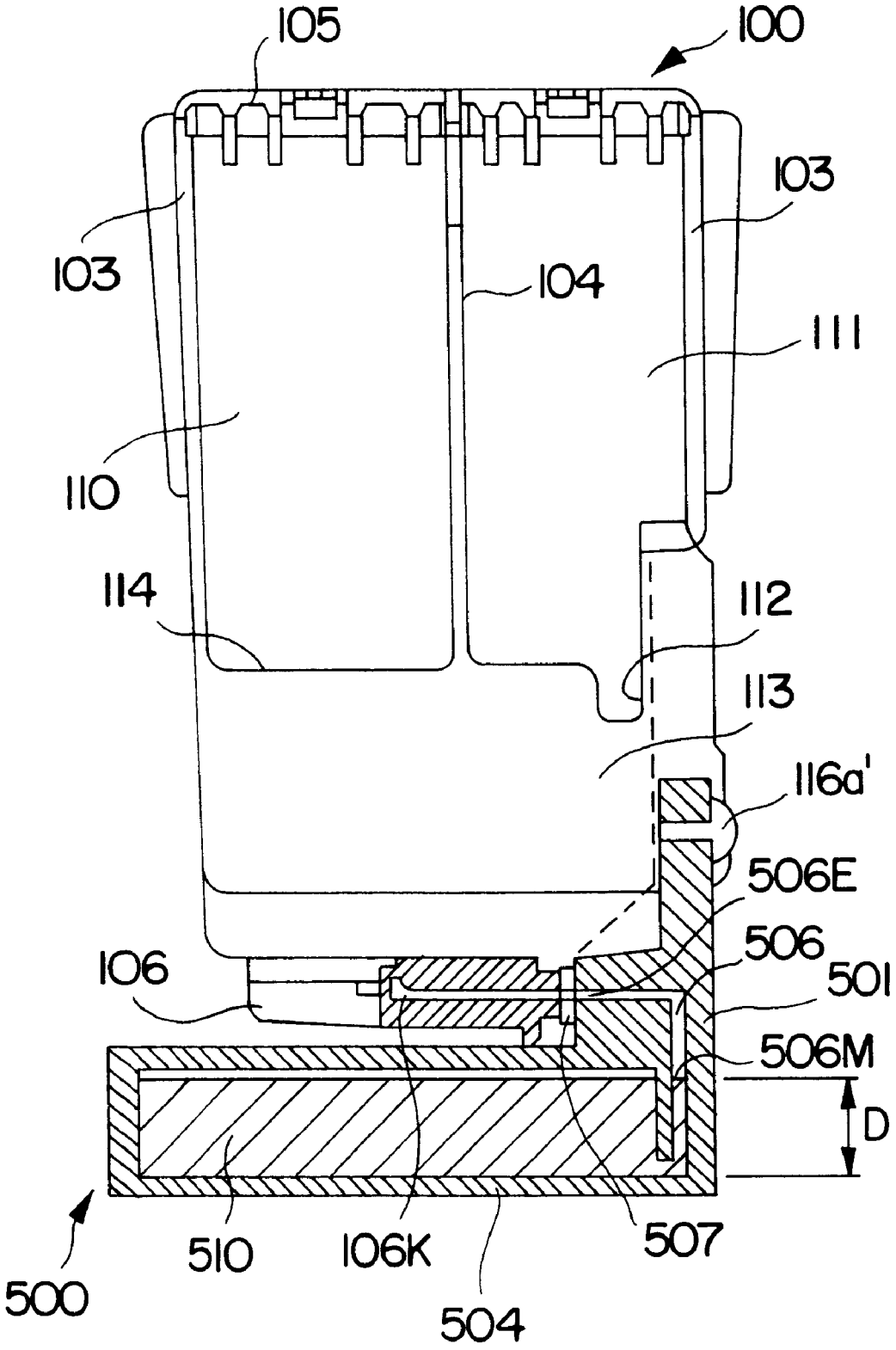
FIG. 17 is a sectional view taken along a line XVII—XVII of FIG. 16(*a*)
Figure 18:
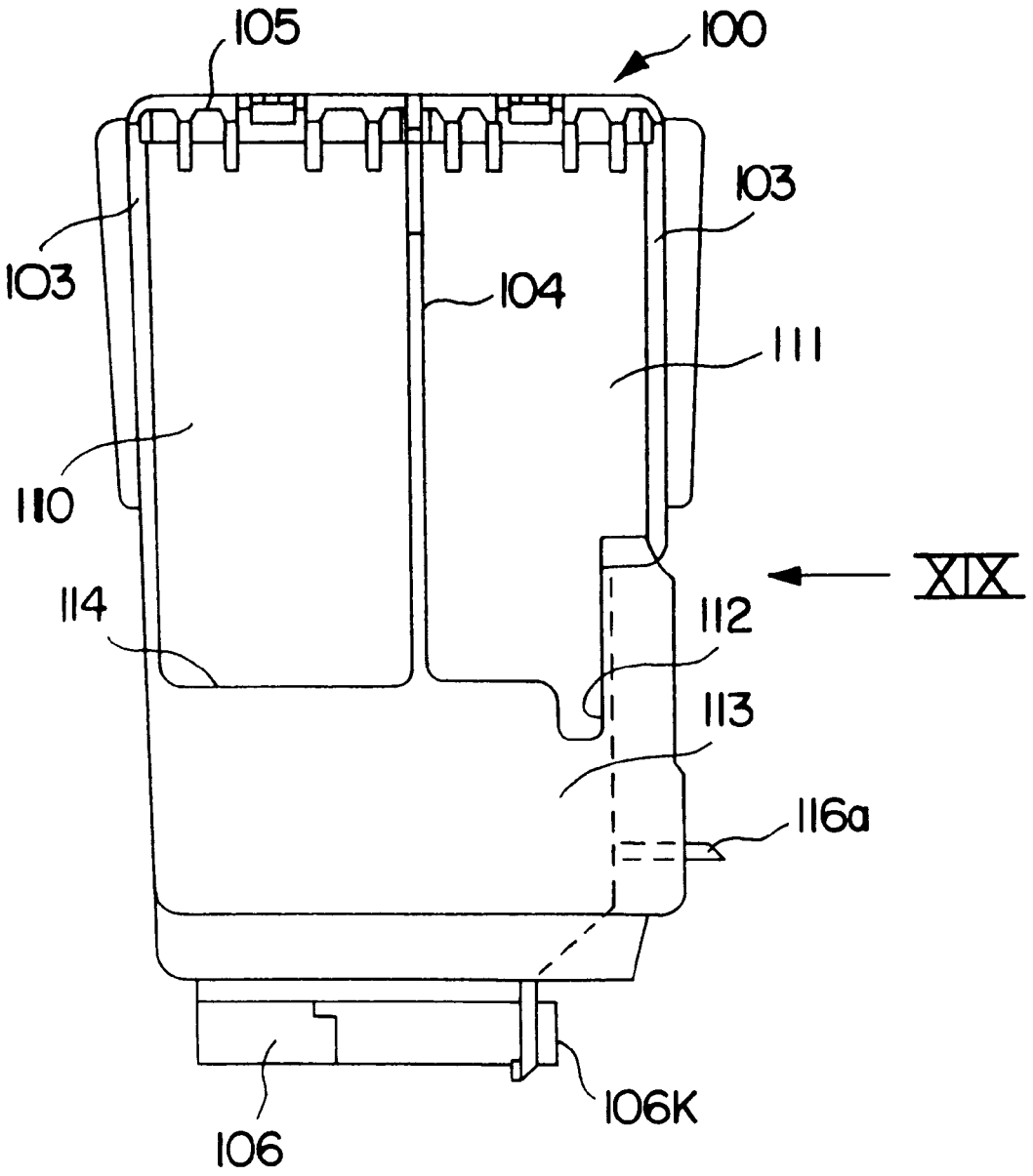
FIG. 18 is a front view of a head holder without the ink container mounted thereto.
Figure 19:
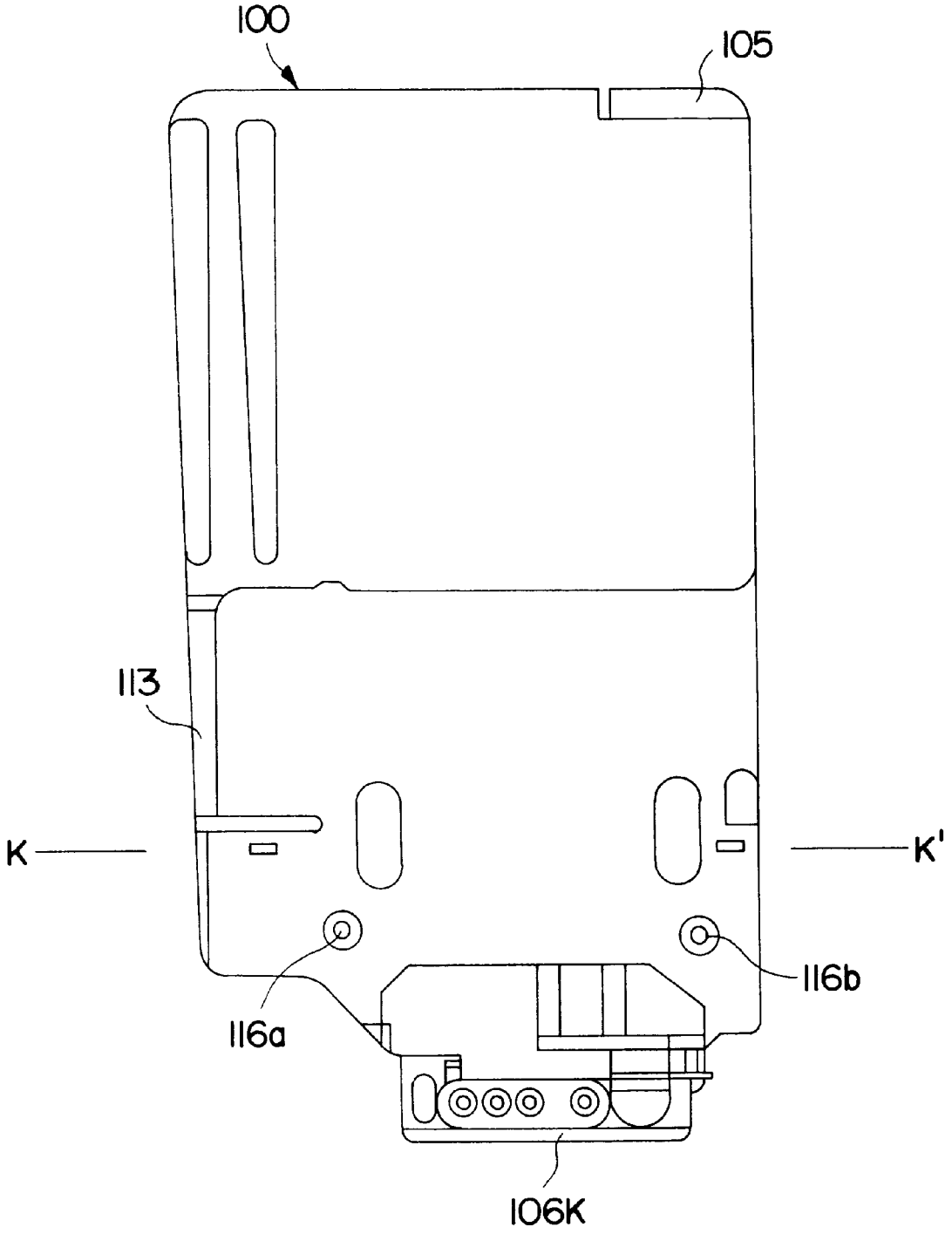
FIG. 19 is a side view of the head holder shown in FIG. 18, viewed from the direction indicated by arrow B in FIG. 18.

FIGS. 16(*a*), 16(*b*) and 17 show another embodiment of an ink container refilling apparatus according to the present invention. In FIG. 16(*a*), the ink container is mounted to the ink refilling apparatus. FIG. 17 is a sectional view taken along a line XVII—XVII of FIG. 16(*a*). An ink holder 100 (holder) is the casing of the ink jet unit 101 of FIGS. 8(*a*) to 8(*c*), and FIGS. 18 and 19 show the outer configuration. FIG. 19 is a view as seen in the direction of arrow B of FIG. 18. In FIGS. 16(*a*) and 18, there Is provided a holder casing 103, a cover 105, a front plate 113, ink discharging portion 107 (Y), an elastic member 108. In the method similar to the ink jet unit of FIGS. 8(*a*) to 8(*e*), the positioning portion or the like is mounted to make the ink container 21 detachably mountable. The main assembly 500 is provided with an ink chamber 504, ink discharging tube 506, a pressurizing bellows 502. The ink chamber contains the ink 510. In this example, the description will be made as to the yellow container, but the same applies to cyan (C), and magenta (M) inks. The holder 100 is positioned relative to the main assembly 500 by positioning pins 116*a* and 116*b,* and they are crimped (116*a*'). By doing so, the ink supply tube cover 106*k* and the ink and an end 506E of the ink discharging tube 506 are positioned. With this state, the gap therebetween is fixed by a bonding agent 507. The bonding agent used at this time, is preferably silicone sealant or urethane sealant in consideration of the passage of the ink.

In FIG. 16(*a*), the ink container is mounted, but before the mounting, the pressurizing bellows 502 is covered with a rubber gap 502*c,* and the ink discharging portion 107Y is covered with a rubber cap (not shown) so as to prevent the leakage of the ink during transportation.

The two caps are removed first. Then, the ink level 509 and the ink meniscus 506M in the ink discharging tube 506 are balanced by the atmospheric pressure to be maintained at the same levels. Subsequently, the ink container 21 used is mounted, and then, the negative static pressure of the ink retaining member 26 in the ink container 21 tends to suck the ink 501 up. However, when the meniscus 506M is formed in the ink discharging tube 506, the ink sucking might be-prevented. As shown in FIG. 16(*b*) the pressurizing bellows 502 are depressed as indicated by an arrow T1 by a finger 511 of the operator, by which the meniscus 506M is raised to be contacted to the discharging member 27Y. By this, the remaining ink (not shown) in the ink container and the ink 510 in the ink chamber 504, continue with each other.

By shifting the finger 511 in the direction T2, the opening to the atmosphere is effected instantaneously. By the above operation, the ink 510 in the ink chamber 504 is assuredly sucked up by the negative static pressure of the ink retaining member 26 in the ink container. Finally, due to the negative pressure characteristics of the ink retaining member 26, the ink level 509 is away from the bottom surface of the ink discharging member 27Y by a distance E, for example, 20 mm. By repeating the ink refilling, the ink in the ink chamber 504 decreases with the result of increase of the distance E. In order to avoid significant change of the negative static pressure property, it is preferable that the ink height D in the ink chamber is 10 mm approx. Therefore, when a large quantity of the ink is to be filled in the ink chamber 504, the ink chamber 506 has a flat shape as shown in FIG. 16(*a*).

Figure 20:
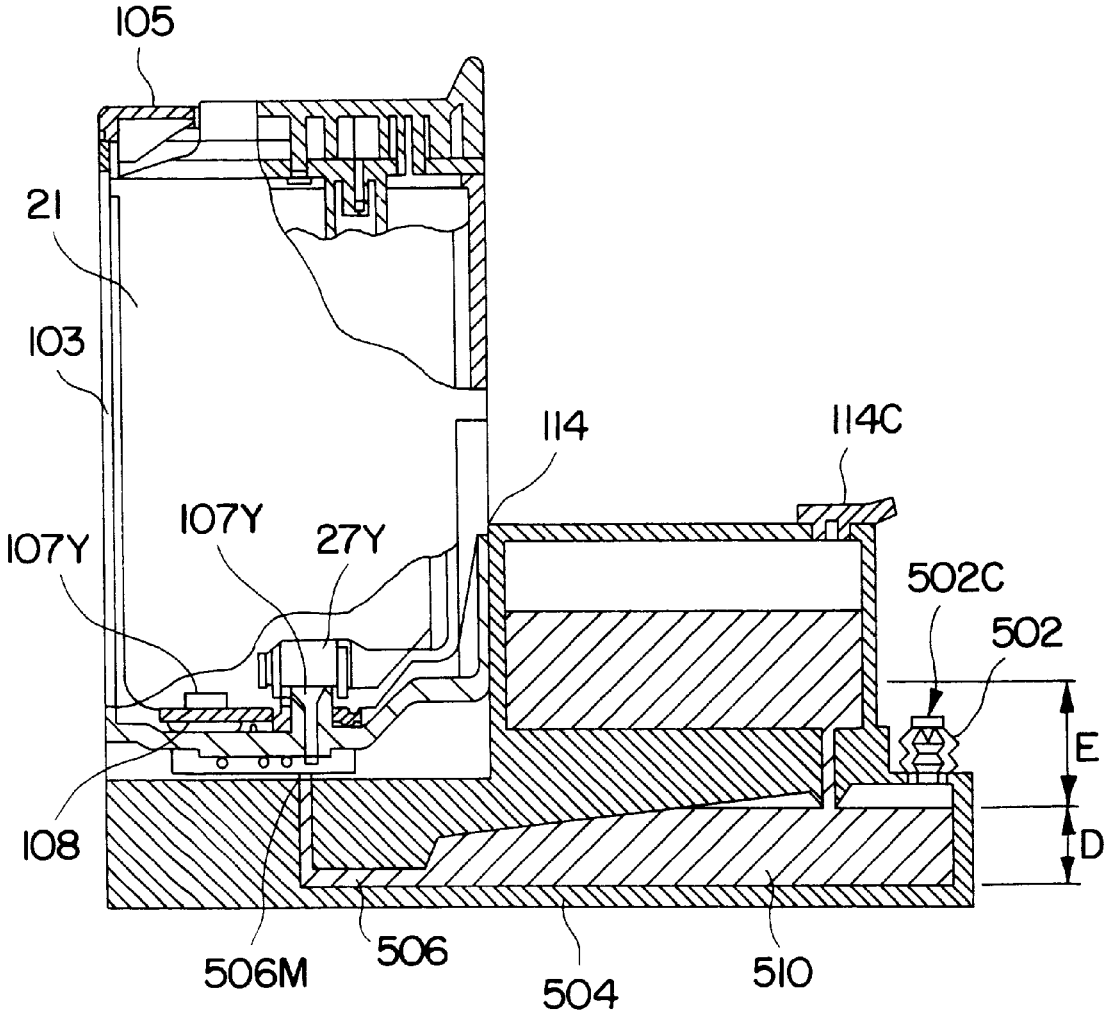
FIG. 20 is a schematic sectional view illustrating an ink refilling method according to a further embodiment, wherein the use is made with a chicken-feed system.

FIG. 20 is a modification of the embodiment of FIGS. 16 and 17. In FIG. 20, the embodiment uses the chicken-feed system to maintain substantially a constant ink level at the ink refilling side in FIGS. 16 and 17. The ink refilling method of FIG. 20 is similar to that of FIGS. 16 and 17, and the description of the common part is omitted, and the different portion is mainly described.

The ink chamber 504 of FIG. 20 is provided with a refilling ink container portion such that an end of the ink supply tube of the refilling ink container of the chicken-feed type to the ink surface 509 of the ink. The refilling ink container portion has an opening which is opened upon the ink filling at the top. The opening is closed by a gap 114C when the ink is to be refilled. When the ink in the ink chamber 504 is consumed for the ink refilling, the ink level 509 slightly lowers, and is departed from the end of the ink supply tube of the ink container. At this time, the end of the supply tube is contacted to the ambient air to take the ambient air into the ink container So as to permit the ink flows from the ink container to increase the ink surface 509. By this rising, the ink level surface 509 is contacted to the end of the supply tube, by which the introduction of the air into the supply tube is stopped, so that the liquid level of the ink 509 can be maintained substantially constant. Accordingly, according to this embodiment, the static head difference upon the completion of the ink refilling, as described in FIGS. 4 and 5, can be assured. Additionally, the static head difference relative to the ink container 21 during the ink refilling operation can be made constant, and therefore, the ink refilling conditions can be maintained constant. In other words, the quantity of the ink refilling in accordance with the negative pressure produced by the ink consumption in the ink container 21, can be assuredly provided.

Figure 21:
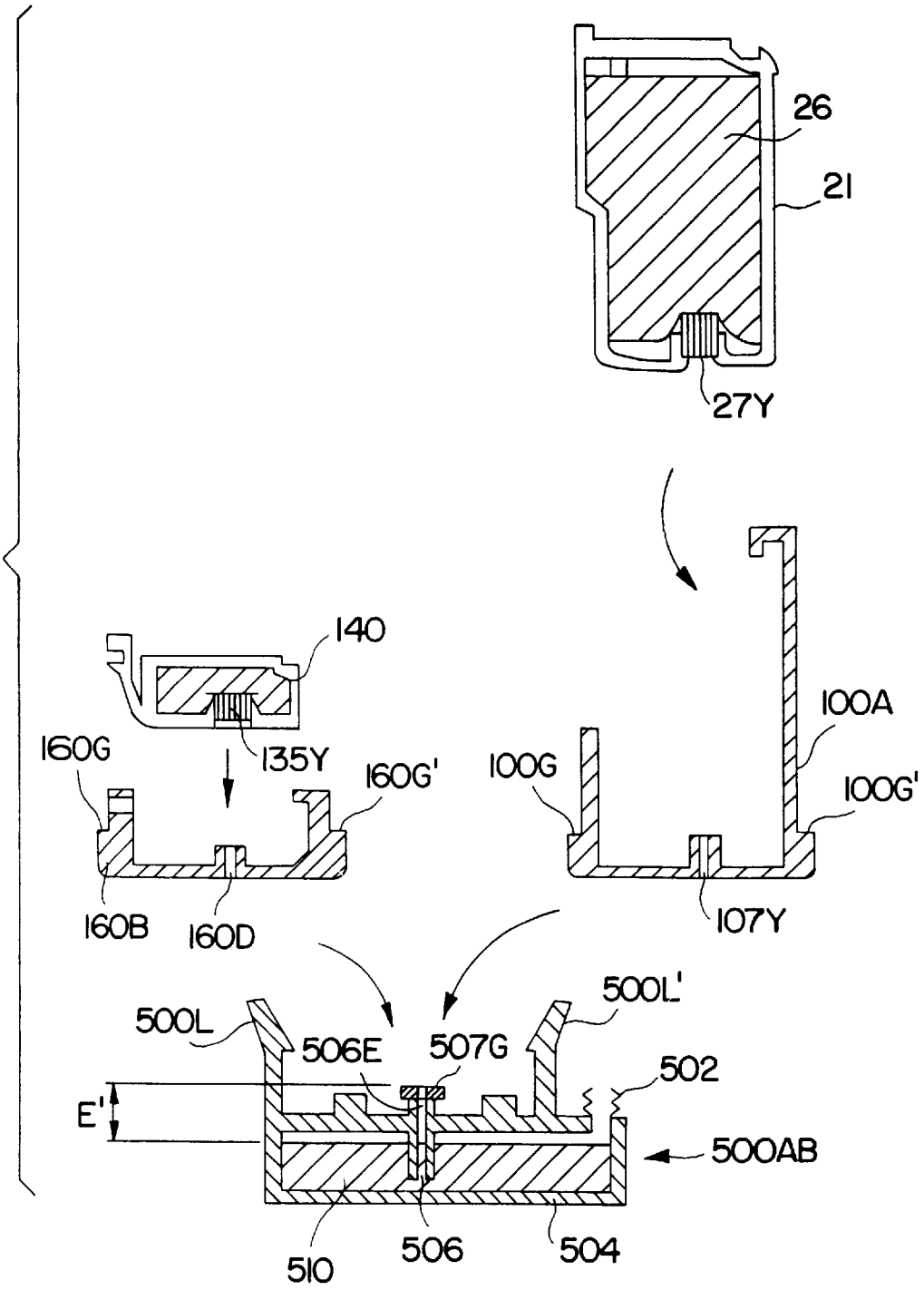
FIG. 21 is a schematic sectional view of an ink refilling apparatus according to a further embodiment.
Figure 22:
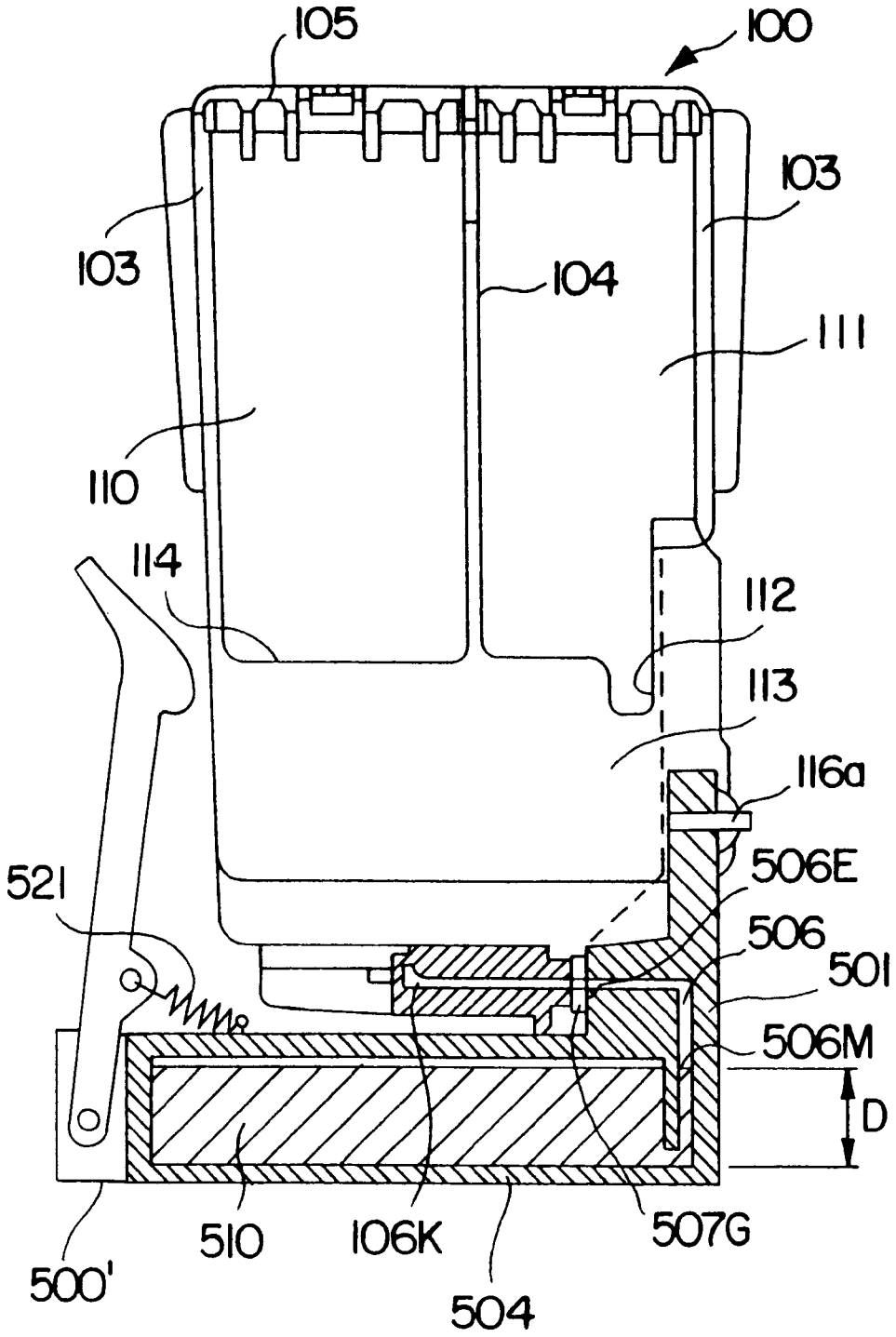
FIG. 22 is a sectional view of an ink refilling apparatus of FIG. 21.
Figure 23:
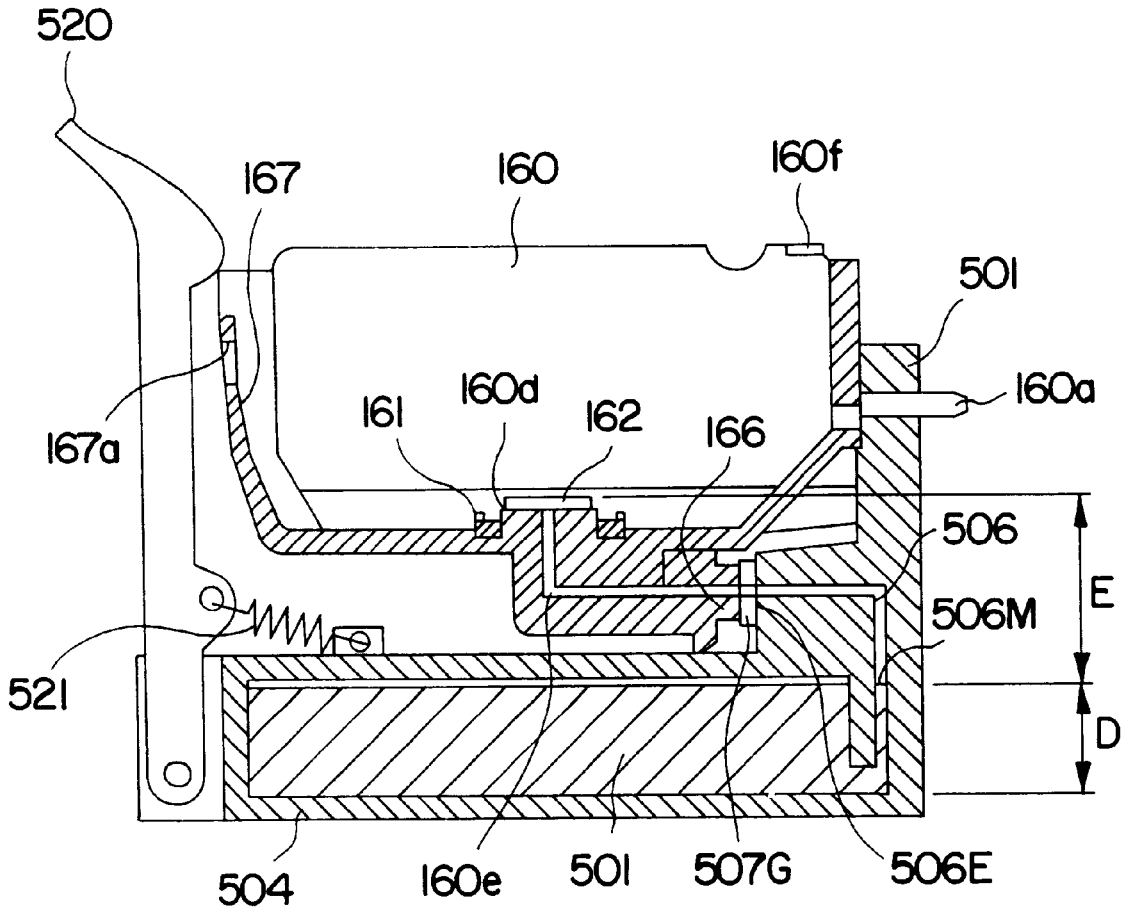
FIG. 23 is a sectional view of a major part of an ink refilling apparatus of FIG. 21.

In FIGS. 21, 22 and 23, a modification of FIGS. 16 and 17 is shown.

In the embodiment of FIGS. 16 and 17, the holder 100 is positioned on the refilling apparatus main assembly 500 by positioning pins, and they are crimped. In the embodiment of FIG. 21, the holder 100A is detachably mountable.

Similarly to the foregoing embodiment of FIGS. 16 and 17, there is provided a positioning portion or the like to permit detachable mounting of the ink container 21.

Similarly to the embodiment of FIGS. 16 and 17, the holder 100*a* is provided with positioning portions or the like so that the ink container 21 is detachably mountable. The main assembly 500AB is provided with an ink chamber 504, ink discharging tube 506, and pressurizing bellows 502. The ink container contains ink 510, similarly to the embodiment of FIGS. 16 and 17.

The holder 100*a* is positioned to the main assembly 500AB of the refilling apparatus by positioning guides 100A and 100A'. Furthermore, it is fixed by locking mechanism 500L and 500L'. By this, the ink supply tube 107Y and the end 506E of the ink discharging tube 506 are positioned correctly. With this state, the gap between the ink supply tube 107Y and the ink discharging tube 506 is sealed by a sealing member 507G already mounted. By doing so, the similar structure as in FIGS. 16 and 17 is provided. As to the manipulation before and after the mounting of the ink container 21, the same as with FIGS. 16 and 17 apply to this embodiment, and the detailed description is omitted.

The ink 510 in the ink chamber 504 is assuredly sucked up by the negative static pressure of the ink retaining member 26 in the ink container 21. Finally, due to the negative pressure property of the ink retaining member 26, the ink level 509 is away from the top surface of the sealing member 507G by a distance E' (10 mm), similarly to the FIGS. 16 and 17 embodiment, in which the ink level 509 is away from the bottom surface of the ink discharging member 27Y by a distance E (20 mm, for example).

Since the holder 100A is detachably mountable, a thin recording apparatus color holder 160B is mounted. The color holder 160B is the same as the holder 100A as to the positioning method relative to the main assembly 500AB and a position of the ink supply tube 160D, and therefore, the mounting is easy. As to the operation before and after the mounting of the color ink container 150 to the color holder 160B, the same as in FIGS. 16 and 17 applies to this embodiment, and the detailed description is omitted, and the mounting method will be described. Since the holder 100A is detachably mountable, the refilling apparatus is usable for various ink containers, and the manufacturing cost and the running cost of the user can be reduced. At this time, the distance E' from the top surface of the sealing member 507 to the ink level 509 in the ink chamber 504 is selected in accordance with the respective ink containers.

FIGS. 22 and 23 show specific example of the FIG. 21 embodiment.

FIGS. 22 and 23 illustrate the embodiments, and similarly to FIG. 17, they are sectional views taken along a line XVII—XVII of FIG. 16, (*a*). The structure of the main assembly 500' includes, similarly to the apparatus of FIG. 17 embodiment, an ink chamber 504, an ink discharging tube 506 and pressurizing bellows 502 (not shown). The ink 510 is contained in the ink chamber.

In FIG. 22, the holder 100 is correctly positioned on the main assembly 500' of the refilling apparatus by positioning pins 116*a* and 116*b*, and in addition, they are fixed by a holder locking lever 520 urged by a spring 521. By doing so, the ink supply tube cover 100*k* and the end 506E of the ink discharging tube 502 are positioned with this state, the ink supply tube cover 106*k* and the end 506E of the ink discharging tube 506, are positioned. With this state, the gap between the ink supply tube 107Y and the ink discharging tube 506 is sealed by a sealing member 507G already mounted thereto. By doing so, the same structure as in embodiment of FIGS. 16 and 17 is provided.

As to the manipulations before and after the mounting of the ink container 21, the same as with FIGS. 16 and 17 embodiment applies, and therefore, the detailed description will be omitted.

With this manipulation, the ink 510 in the ink chamber 504 is assuredly sucked up by the static negative pressure of the ink retaining member 26 in the ink container. Finally, due to the negative static pressure property peculiar to the ink retaining member 26, the ink level 509 is away from the top surface of the sealing member 509G by a distance E' (10 mm), similarly to the FIGS. 16 and 17 embodiment in which the ink level 509 is away from the bottom surface of the ink discharging member 27Y by a distance E, for example, 20 mm.

Using the feature of this embodiment, that is, the holder 100 is detachably mountable, a thin recording apparatus color hole 160 is mounted (FIG. 23). The color holder 160 is the same in the positioning-method relative to the main assembly 500' and the ink supply tube 160*d* position or the like (below the line K—K' in FIG. 19) so as to permit common recording head (201, 150) is usable with the holder 100. As to the manipulations before and after the color ink container 150 to the color holder 160, the same applies to the embodiment of FIGS. 16 and 17, and therefore, the description is omitted.

Figure 24:
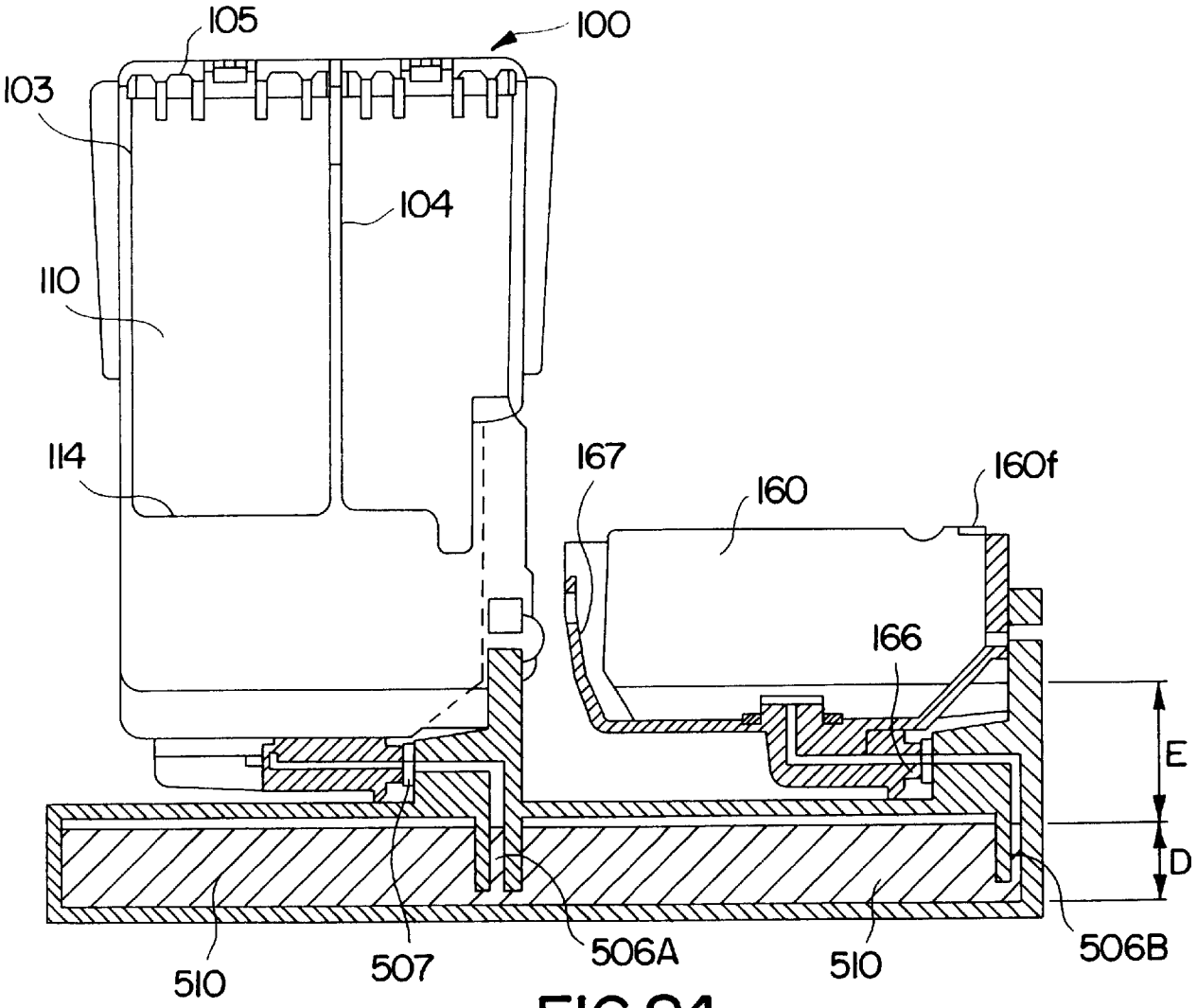
FIG. 24 is a sectional view of a major part illustrating an ink refilling method according to a further embodiment.

FIG. 24 is a modified embodiment of FIG. 21 embodiment. In the embodiment of FIG. 21, the holder 100*a* and the color holder 160*b* are detachably mountable with each other. In FIG. 24, they are both provided, by which ink containers with difference holders is capable of being refilled with the ink without the necessity of the exchange of the holder. However, during the refilling, the meniscus of the absorbing member is broken, end therefore, it is necessary to raise the ink level in the ink discharging tube 506*a* and 506*b* toward the ink absorbing material. However, since the ink overflows if the ink container is not mounted to one of the holder, and therefore, in the refilling operation, it is necessary that all of the ink containers are mounted.

In the foregoing embodiments, the ink container may be for a single color or for multicolors, and one or more ink absorbing materials are usable.

Figure 25:
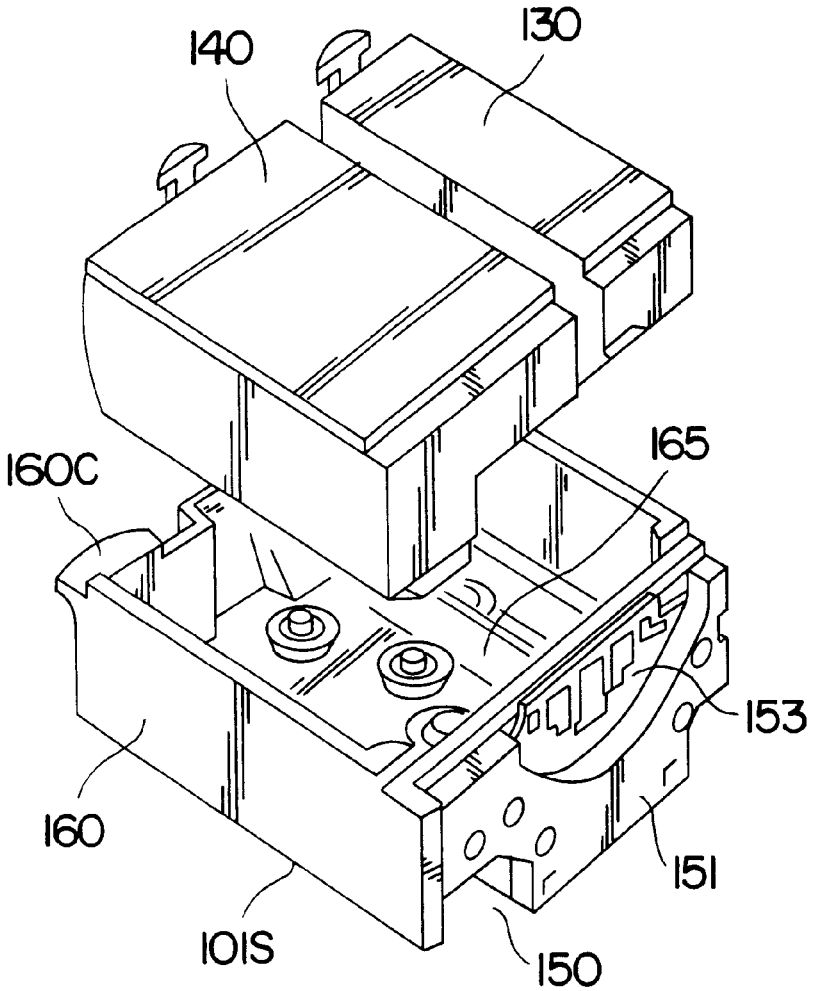
FIG. 25 is a perspective view of a color recording head cartridge mounted to the ink jet recording apparatus together with two ink containers fused thereto.
Figure 26:
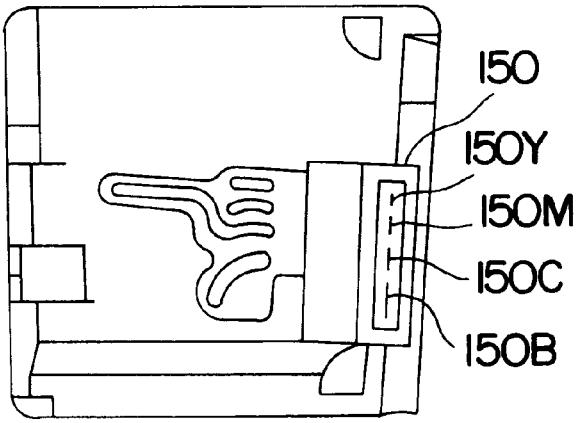
FIG. 26 is a bottom view of the color recording head cartridge of FIG. 25.

FIG. 25 is a perspective view of a color recording head cartridge usable with a thin type ink jet recording apparatus, with two ink container mounted thereto. In the color recording head cartridge 101S, a black ink container 130 containing black ink, and color ink container 140 containing yellow, magenta and cyan inks, are detachably mountable. It is capable of ejecting four color inks. To accomplish this, the nozzle portion 150, as shown in FIG. 26, is divided into a black ink ejecting group 150B, and yellow ejection group 150Y, a magenta ejection group 150M and cyan ejection group 150C. In order to define the regions for the mounting of the ink containers 130 and 140, the bottom wall of the color holder has an integral partition plate 165.

Figure 29:
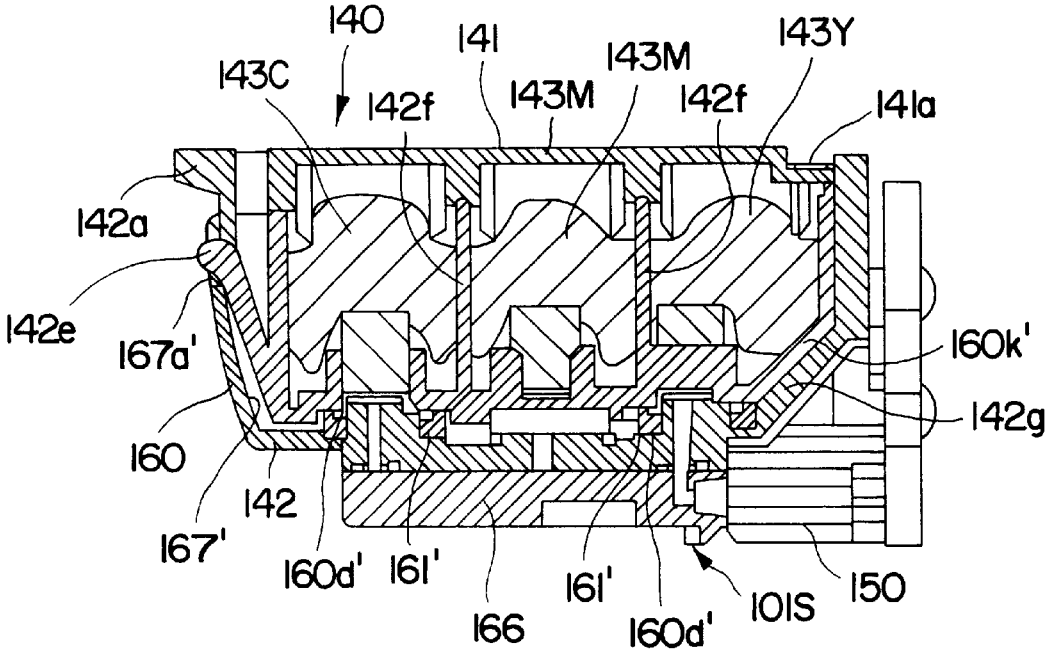
FIG. 29 is a sectional view taken along a line XXIX—XXIX of FIG. 27.

The description will be made as to the color recording head cartridge 101S and each ink container 130 and 140. FIG. 29 is a sectional view of a thin type color recording head cartridge 101S, wherein only one of the two ink containers, that is a color ink container 150, is mounted.

Figure 27:
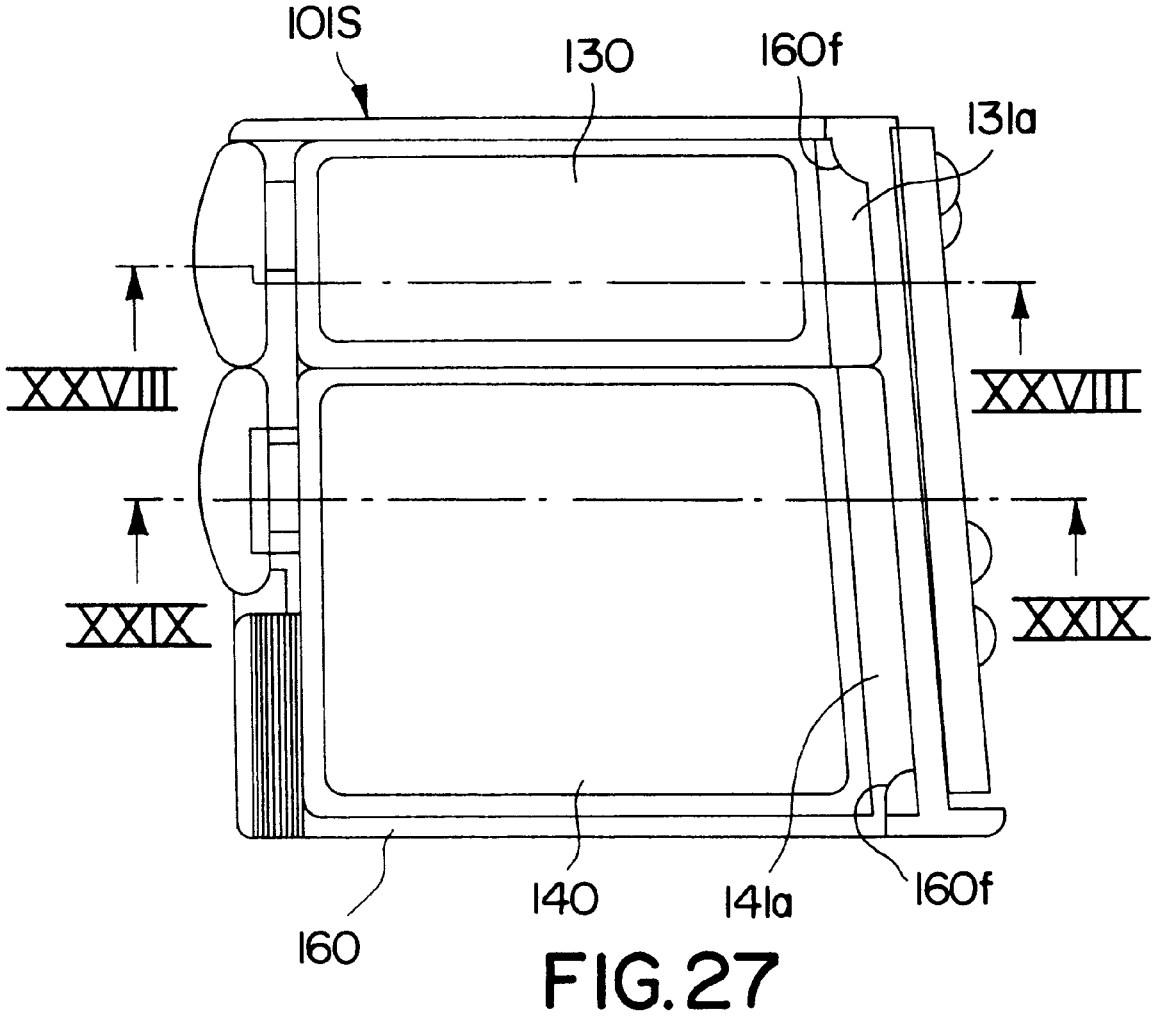
FIG. 27 is a top plan view of a color recording head cartridge of FIG. 25, wherein two ink containers are mounted.
Figure 28:
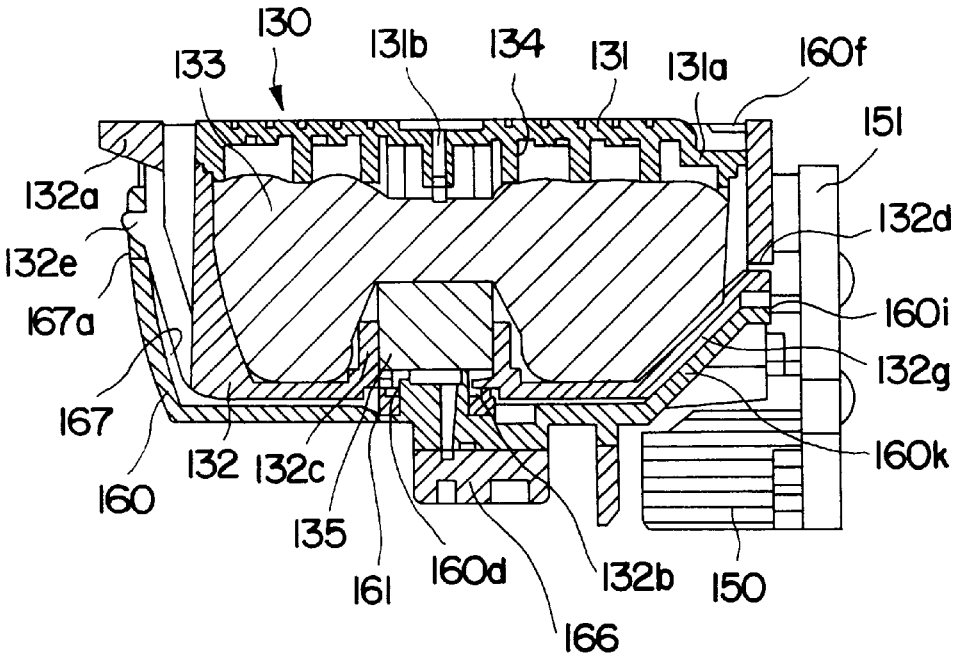
FIG. 28 is a sectional view taken along a line XXVIII—XXVIII of FIG. 27.

As shown in FIG. 27, the black ink container 130 and the color ink container 140, are mounted to the color holder 150 adjacent to each other. The black ink container 130, as shown in FIG. 28 (which is taken along the secion line XXVIII—XXVIII of FIG. 27), has a container 132 for containing the black ink, and a cover member 131 which covers the container 132 and which is provided with an air vent 131*b*.

The bottom of the container 132 is provided with an ink supply opening 132*b* into which an ink taking tube 160*b* for the black ink is inserted, and a cylindrical support 132*c* is formed therearound. Before the black ink container 130 is mounted to the color holder 160, the ink supply tube 132*b* is sealed by a sealing member (not shown), and the ink leakage is prevented.

The ink absorbing material 133 is accommodated in the container 132, and the black ink is absorbed and retained in the ink absorbing material 133. Into the supporting portion 132*c*, an ink supply member 135 constituted by a bundle of unidirectional fibers is inserted and supported, and the ink absorbing material 133 is contacted to the top surface of the ink supply member 135. The ink absorbed in the ink absorbing material 133 is supplied to the ink supply opening 132*b* through the ink supply member 135. When the black ink container 130 is mounted to the color holder 160,,the ink taking tube 150*d* of the color holder 160 is inserted into the ink supply opening 132*b*, and the ink is supplied to the black ink ejection group 150*b* of the nozzle portion 150 through the ink passage constituted by the color holder 160 and the liquid passage cover 166 (FIG. 29). In FIG. 28, the path to the nozzle portion 150 is not shown because of the line along which the figure is taken. At this time, the seal ring 161 around the ink supply opening 132*b* is closely contacted to the outer edge of the ink supply opening 132*b* to prevent the leakage of the ink.

In order to ink ejection or exposure through the ink supply opening 132*b* upon the removal of the sealing member sealing the ink supply opening 132*b*, the ink supply opening 132*b* and the air vent 131*b* are in fluid communication through an air layer. To accomplish this, a rib 134 is provided (in FIG. 28, only a rib 134 of the cover member 131 is shown). At a predetermined position inside the cover member 131 and inside the container 132, by which a predetermined gap is provided between the ink absorbing material 133 and the container 132 and the cover member 131, and in addition, a slit (not shown) to provide fluid communication between the inside and outside of the container 132 is formed in a part of the supporting member 132*c*.

On the other hand, as the mounting and demounting structure of the black ink container 130 for the color holder 160, the container 132 has an integral engaging claw 132*d* on a surface contacted to the inner wall of the color holder 160 adjacent the base plate 151 when the black ink container 130 is mounted to the color holder 160. The engaging claw 132*d* is engaged with a hole 160*i* formed in the holder 160. It functions as a guide upon the mounting of the black ink container 130 to the color holder 160, and in addition when the black ink container 130 is mounted to the color holder 160, it holds the black ink container 130. A latching lever 132*a* having a bottom end elastically supported is integrally formed on the outer wall at a side opposite from the claw 132*d*.

Corresponding to the position of the latch lever 132, the color holder 160 is provided with a latch lever guiding groove 167 for the black ink container 130. When the black ink container 130 is to be mounted to the color holder 160, the latch lever 132*a* is inserted along the latch lever guide groove 167. When the black ink container 130 is mounted to the color holder 160, the latching lever 132*a* vends by being urged by the latching lever guiding groove 167, and the latching pole 132*c* formed in the latching lever 132*a* is engaged with the latching hole 167*a* formed in the latch lever guiding groove 167.

An inclined surface 160*k* is formed in a region of the color holder 160 where the black ink container 130 is mounted, and an inclined surface 132*g* is formed correspondingly to the inclined surface 160*k*. As regards the cover member 131, a lowered step 131*a* is formed at an end adjacent the claw 132*d*. Correspondingly, the color holder 160 is provided with a projection 160*f*. The mounting and demounting of the black ink container 130 to the color holder 160 is as follows. When the black ink container 130 is to be mounted, the black ink container 130 is inclinedly inserted from the side having the claw 132*d* to a position where the black ink container 130 of the color holder 160 is mounted, so that the stepped portion 131 is inserted below the projection 160*f* (FIG. 27) adjacent the black ink container 130 on the color holder 160. In addition, the claw 132*d* is hooked with the hole 160*i* of the color holder 160. Thereafter, the black ink container 130 is pushed down to rotate it about a side having the claw 132*d* to engage the latching claw 132*e* of the latching lever 132*a* with a hole 167*a* of the latching lever guiding groove 167. When the black ink container 130 is to be taken out, the latching lever 132*a* is pushed inwardly to disengage the latching claw 132*e* and the engaging hole 167*a*.

The fundamental structure of the color ink container 140 is the same as with the black ink container 130. As shown in FIG. 29 (which is taken along the secion line XXVIII—XXVIII of FIG. 27), it comprises a container 142 for containing three color inks and a cover 141 for covering the container 142. Upon the mounting to the color holder 160, the stepped portion 141*a* at the position similar to that of the black ink container 130 is inserted inclinedly below the projection 160*f* adjacent the color ink container 140 (FIG. 27).

Figure 30:
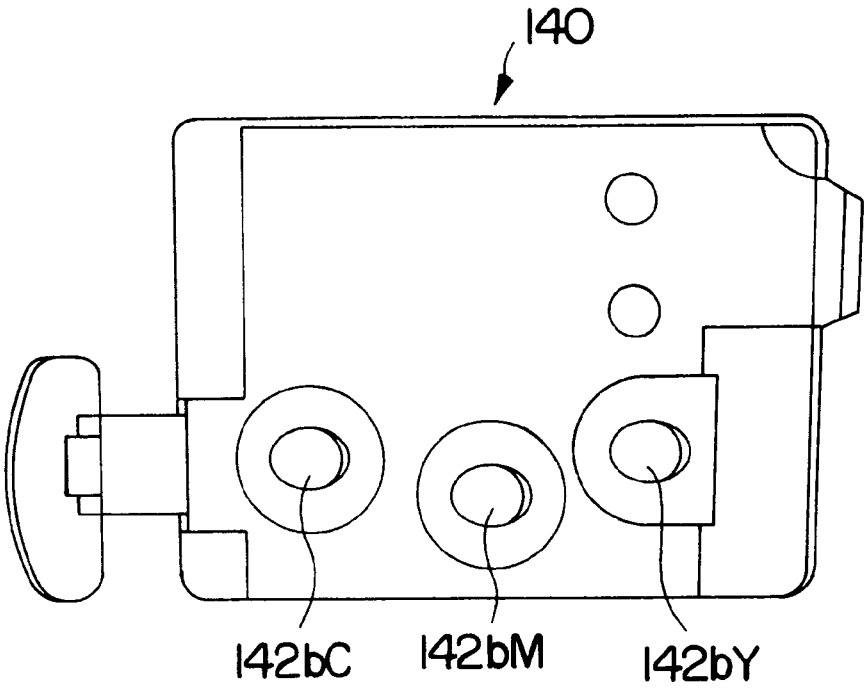
FIG. 30 is a bottom view of a color ink container shown in FIG. 25.

The inside of the container 142 is divided into three spaces having substantially the same capacities by two partition plates 142*f* which are parallel with each other. The provided three spaces are arranged in a direction of insertion of the color ink container 140 upon the mounting of the color ink container 140 to the recording head cartridge 101S. In the spaces, an ink absorbing material 143Y for absorbing and retaining yellow ink, and an ink absorbing material 143M for absorbing and retaining magenta ink container, and an ink absorbing material 143C for absorbing and retaining cyan ink. As shown in FIG. 30 (bottom view), the ink supply openings 142*b*Y, 142*b*M, 142*b*C opened to the atmosphere are also formed along the inserting direction of the color ink container 140. Corresponding to the positions of the ink supply openings 142*b*Y, 142*b*M and 142*b*C, the color holder 160 is provided with three ink taking tubes 160*d'* (the magenta ink taking up tube is not shown in FIG. 29). The ink taking up tube 160*d'* is in fluid communication with ejection grooves 150Y, 150M and 150C (FIG. 26) through the ink passage constituted by the liquid passage cover 166. In FIG. 29, the passage to the nozzle portion 150 of the ink passage is shown only for yellow. The seal ring 161' is provided for each of the ink taking tube 160*d*', but that for the magenta ink is not shown in FIG. 29.

Figure 31:
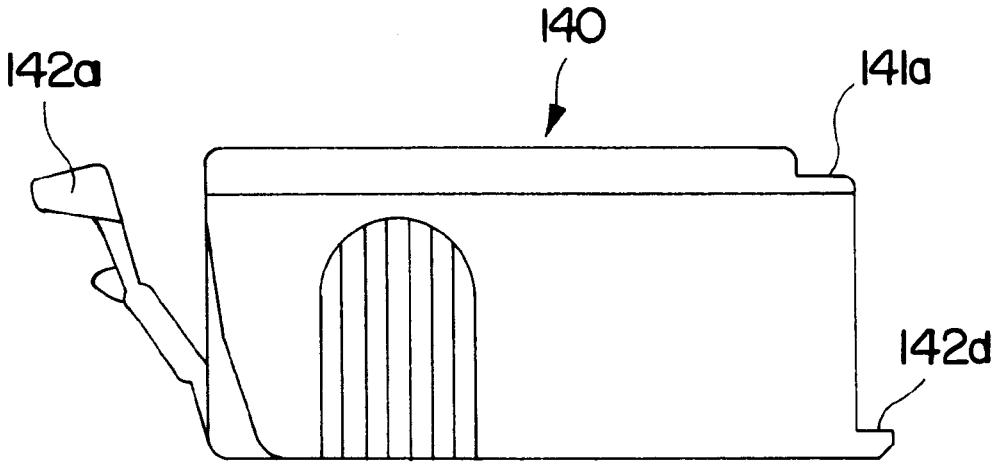
FIG. 31 is a side view of a color ink container of FIG. 25.

On the other hand, the mounting and demounting mechanism of the color ink container 140 to the color holder 160 is also similar to that of the black ink container 130. As shown in FIG. 31, it comprises in addition to the stepped portion 121*a,* a latching lever 142*a* and the engaging claw 142*d*. As shown in FIG. 29, the latching lever 142*a* is engaged with a latch lever guiding groove 167' formed in the color holder 160. When the color ink container 140 is mounted in the color holder 160, the latching claw 142*e* formed in the latching lever 142 is engaged with the latch engaging hole 167*a*' formed in the latching lever guiding groove 167'. The engaging claw 142*d* is formed at the bottom end of the surface opposite from the surface having the latching lever 142*a*. Corresponding to the position, the color holder 160 has a hole (not shown) engageable with the engaging claw 142*d*.

In the region of the color holder 160 to which the color ink container 140 is mounted, as shown in FIG. 29, an inclined surface 160*k*' is formed, and the color ink container 140 has an inclined surface 142*g* corresponding to the inclined surface 160*k'*.

The mounting and demounting operation of the color ink container 140 relative to the color holder 160, similarly to the mounting and demounting manipulation of the black ink container 130, the side having the claw 143*d* is inserted into the color holder, and it is inserted while rotating about that portion. The latching lever 142*a* is pushed inwardly to remove it. Here, when the color ink container 140 is mounted to the color holder 160, the ink supply ports 142*b*Y, 142*b*M and 142*b*C of the color ink container 140 are arranged along the inserting direction of the color ink container 140. Therefore, with the rotation of the color ink container, the ink supply openings 142*b*Y, 142*b*M and 142*b*C are engaged with the ink take tube 160' sequentially from the side having the claw 142*d,* and therefore, the jointing between the color ink container 140 and the color recording head cartridge 101S is stabilized.

As described in the foregoing, according to these embodiments of the present invention, the ink container replaceable relative to the ink jet unit can be refilled without the necessity for use of needles, without ink leakage, without binding the user for a long period and with simple structure.

By using the ink container supporting member of the ink jet recording apparatus as a ink container retaining portion of the ink refilling apparatus, or by using the same configuration, the ink refilling state is closest to that during the recording operation, and therefore, the optimum ink distribution can be provided. In addition, the ink passage state is such that the ink is electable after the ink refilling.

While the invention has been described with reference to the structures disclosed herein, it is not confined to the details set forth and this application is intended to cover such modifications or changes as may come within the purposes of the improvements or the scope of the following claims.

What is claimed is:

1. An ink refilling method for refilling an ink container with ink, the ink container having a porous material capable of providing a capillary force, an ink supply port for supplying ink to a recording head detachably mountable to the ink container, an ink discharging member having a bundle of uni-directional fibers which are provided at said ink supply port and contacted to said porous material, and an air vent portion at a position away from said ink supply port, wherein at least a part of initially-contained ink retained by the porous material has been consumed to leave a remaining amount of ink forming an ink meniscus in an ink supply port side of the ink discharging member, the method comprising the steps of:

breaking the ink meniscus at the ink supply port side of the ink discharging member; and supplying additional ink into the ink container from an ink source by a capillary force of the porous material at said ink supply port by consumption of the initially contained ink while said air vent portion is kept open to atmospheric air, while said ink supply port is disposed below a low position of the ink container, while said additional ink is in fluid communication with atmospheric air, and while fluid communication between the ink discharging member and the ink source is maintained.

2. An ink refilling method according to claim 1, wherein said ink container has a plurality of ink accommodating chambers for different color inks, and each of the plural ink accommodating chambers contains a respective porous material and a respective ink supply port, and wherein the ink supply ports of the respective ink accommodating chambers are on a same plane, and the additional ink includes different inks corresponding to the respective ink accommodating chambers that are supplied respectively to the respective ink supply ports, wherein said step of supplying additional ink supplies ink to the respective accommodating chambers on the basis of the capillary forces produced by the porous materials.

3. An ink refilling method according to claim 1, wherein an ink level in said ink source is maintained constant in said ink supplying step.

4. An ink refilling method according to claim 1, wherein said ink source includes an ink discharging tube for contact with said ink discharging member, said method further comprising a step of at least temporarily removing air from an ink refilling path in the ink discharging tube prior to said step of breaking the ink meniscus.

5. An ink refilling method according to claim 1, wherein said step of breaking the ink meniscus breaks the meniscus by pressurizing or sucking into said ink source.

6. An ink refilling method according to claim 1, wherein said supplying step is carried out by direct contact between the ink discharging member at said ink supply port and the ink in the ink source.

7. An ink refilling apparatus for refilling ink into an ink container, said ink container having a porous material capable of providing capillary force, an ink supply port for supplying ink to a recording head detachably mountable to the ink container, an ink discharging member having a bundle of uni-directional fibers provided at said ink supply port and contacted to said porous material, and an air vent portion at a position away from said ink supply port, wherein at least a part of initially-contained ink retained by the porous material has been consumed to leave a remaining amount of ink forming an ink meniscus in an ink supply port side of the ink discharging member, the apparatus comprising:

an ink container holding portion for holding said ink container with said ink supply port taking a low position below said ink container and with said air vent portion of said ink container being kept open to ambience, said ink container holding portion including a bypass and a valve;

ink discharging means for retaining additional ink and for supplying the additional ink to the porous material in said ink container, said ink discharging means including a supply tube, wherein said bypass and said valve are arranged for at least temporarily removing air from said supply tube prior to refill of ink to the ink container when said holding portion holds the in container; and means for breaking the meniscus of the ink at the ink supply port side of said ink discharging member, said meniscus breaking means being provided in said ink discharging means, wherein fluid communication between the ink in the ink discharging member and the additional ink retained in said discharging means is established by said meniscus breaking means, and thereafter the additional ink is supplied into said ink container by the capillary force of the porous material by consumption of the initially contained ink.

8. An ink refilling method for refilling an ink container with ink, the ink container having a porous material capable of providing a capillary force, an ink supply port for supplying ink to a recording head detachably mountable to the ink container, an ink discharging member having a bundle of uni-directional fibers which are provided at said ink supply port and contacted to said porous material, and an air vent portion at a position away from said ink supply port, wherein at least a part of initially-contained ink retained by the porous material has been consumed to leave a remaining amount of ink forming an ink meniscus in an ink supply port side of the ink discharging member, wherein ink is refilled from an ink source having an ink discharge tube for contact with the ink discharging member, the method comprising the steps of:

at least temporarily removing air from an ink refilling path in the ink discharging tube, wherein air removed by said air removing step moves to the ink discharging member to close fluid communication and form a meniscus in the ink discharging member;

breaking the ink meniscus at the ink supply port side of the ink discharging member; and supplying additional ink into the ink container from the ink source by a capillary force of the porous material at said ink supply port by consumption of the initially contained ink while said air vent portion is kept open to atmospheric air, while said ink supply port is disposed below a low position of the ink container, and while fluid communication between the ink discharging member and the ink source is maintained.

9. An ink refilling method according to claim 8, further comprising the steps of detecting motion of the air removed to the ink discharging member by said air removing step, and detecting completion of refilling on the basis of a result of the motion detecting step.

10. An ink refilling apparatus for refilling ink into an ink container, said ink container having a porous material capable of providing capillary force, an ink supply port for supplying ink to a recording head detachably mountable to the ink container, an ink discharging member having a bundle of uni-directional fibers provided at said ink supply port and contacted to said porous material, and an air vent portion at a position away from said ink supply port, wherein at least a part of initially-contained ink retained by the porous material has been consumed to leave a remaining amount of ink forming an ink meniscus in an ink supply port side of the ink discharging member, the apparatus comprising:

an ink container holding portion for holding said ink container with said ink supply port taking a low position below said ink container and with said air vent portion of said ink container being kept open to ambience;

ink discharging means for retaining additional ink and for supplying the additional ink to the porous material in said ink container, said ink discharging means including fluid communication means for maintaining fluid communication between said retained additional ink and atmospheric air; and means for breaking the meniscus of the ink at the ink supply port side of said ink discharging mender, said meniscus breaking means being provided in said ink discharging means, wherein fluid communication between the ink in the ink discharging member and the additional ink retained in said discharging means is established by said meniscus breaking means, and thereafter the additional ink is supplied into said ink container by the capillary force of the porous material by consumption of the initially contained ink while the additional ink is in fluid communication with atmospheric air.

11. An apparatus according to claim 10, wherein said ink discharging means uses a positioning mechanism of a mounting mechanism for mounting said ink container to the recording head.

12. An apparatus according to claim 10, wherein at least two ink containers for different inks are held in said ink container holding portion, wherein said ink discharging means contains the different inks, and wherein respective negative pressure in said ink containers is used to supply the different inks.

13. An apparatus according to claim 10, wherein said ink discharging means includes ink retaining members having different dimensions.

14. An ink refilling apparatus according to claim 10, wherein said ink discharging means includes an ink supply tube-provided at its end with rods having a small cross-section opposed to each other to form a slit therebetween, and wherein upon insertion into said ink discharging member, the rods between which the ink extends to an end portion of the slit breaks the ink meniscus and forms fluid communication of the ink.

15. An apparatus according to claim 10, wherein said discharging means includes a pipe for directly contacting said ink discharging member in said ink supply port and the ink in said apparatus.

16. An apparatus according to claim 10, wherein said ink discharging means is exchangeable.

17. An ink refilling apparatus according to claim 16, wherein said ink container holding portion includes positioning means used commonly for positioning said ink container and said ink discharging means, and an ink supply tube at least partly common to said ink container holding portion and said ink discharging means.

18. An ink refilling method for refilling an ink container with ink from an ink source, the ink container having a porous material capable of providing capillary force, an ink connecting zone for supplying ink to a recording head detachably mountable to the ink container, an ink absorbing portion in the connecting zone, and an air vent portion at a position away from said connecting zone, wherein at least a part of initially contained ink retained by the porous material has been consumed to leave a remaining amount of ink forming an ink meniscus in the ink absorbing portion, the method comprising the steps of:

breaking the ink meniscus at the ink absorbing portion of the ink container;

directly contacting the ink absorbing portion of said connecting zone to ink in the ink source; and supplying additional ink from the ink source into the ink container by a capillary force of the porous material at said connecting zone by consumption of the initially contained ink, wherein said supplying step supplies additional ink while ink in the ink source is maintained in direct contact to the ink absorbing portion pursuant to said directly contacting step, while said air vent portion is kept open to atmospheric air, while the additional ink is in fluid communication to atmospheric air, and while said connecting zone is disposed below a low position of the ink container.

19. An ink refilling apparatus for refilling ink into an ink container, said ink container having a porous material capable of providing capillary force, a connecting zone for supplying ink to a recording head detachably mountable to the ink container, an ink absorbing portion in the connecting zone, and an air vent portion at a position away from said connecting zone, wherein at least a part of initially-contained ink retained by the porous material has been consumed to leave a remaining amount of ink forming an ink meniscus in the ink absorbing portion, the apparatus comprising:

an ink container holding portion for holding said ink container with said connecting zone taking a low position below said ink container and with said air vent portion of said ink container kept open to ambience;

ink discharging means for retaining additional ink and for supplying the additional ink to the ink absorbing material in said connecting zone, said ink discharging means including fluid communication means for maintaining fluid communication between said retained additional ink and atmospheric air; and means for breaking a meniscus of the ink in said connecting zone, said meniscus breaking means being provided in said ink discharging means, wherein said ink discharging means includes a pipe for directly contacting an ink absorbing portion of said connecting zone with the ink in said apparatus, and fluid communication between the ink in the connecting zone and the additional ink retained in said discharging means is established by said meniscus breaking means, and thereafter the additional ink is supplied into said ink container by the capillary force of the porous material by consumption of the initially contained ink while the additional ink is in fluid communication with atmospheric air.

* * * * *

UNITED STATES PATENT AND TRADEMARK OFFICE

CERTIFICATE OF CORRECTION

PATENT NO. : 6,116,722
DATED : September 12, 2000
INVENTOR(S) : Sato et al.

It is certified that error appears in the above-identified patent and that said Letters Patent is hereby corrected as shown below:

Title page,
Item [56], References Cited, insert:

| | | |
|---|---|---|
| -- 0 611 656 | 8/1994 | European Pat. Off. |
| 5-104735 | 4/1993 | Japan ..... 347.86 --. |

Column 1,
Line 66, "is" should read -- be --.

Column 2,
Line 23, "into" should be deleted;
Line 36, "is" should read -- being --;
Line 47, "exist" should read -- exists --; and
Line 64, "after" should read -- after being --.

Column 3,
Line 63, "chamber" should read -- chambers --.

Column 4,
Line 1, "includes" should read -- include --;
Line 16, "uniforming" should read -- making uniform --;
Line 37, "jetting" should read -- jet --;
Line 55, "means," should read -- means or --; and
Line 60, "part" should read -- parts --.

Column 5,
Line 16, "uniforming" should read -- making uniform --.

Column 7,
Line 6, "in" should read -- ink --; and
Line 31, "direction R" should read -- direction H --.

Column 8,
Line 11, "82" should read -- θ2 --;
Line 13, "PL" should read -- PE --; and
Line 30, "decreases" should read -- decreases. --.

Column 9,
Line 31, "FIG. (E)," should read -- 8(e), --; and
Line 32, "an" should be deleted.

UNITED STATES PATENT AND TRADEMARK OFFICE

CERTIFICATE OF CORRECTION

PATENT NO. : 6,116,722
DATED : September 12, 2000
INVENTOR(S) : Sato et al.

It is certified that error appears in the above-identified patent and that said Letters Patent is hereby corrected as shown below:

Column 10,
Line 9, "A" should read -- a --;
Line 17, "an elastic plate" should read -- elastic plates --;
Line 18, "is" should read -- are --;
Line 19, "plate" should read -- plates --; and "functions" should read -- function --;
Line 24, "to" should be deleted;
Line 29, "To the" should read -- The --; and
Line 31, "a" should be deleted.

Column 11,
Line 4, "faced" should read -- facing --;
Line 5, "to" should be deleted; and
Line 59, "apparatus, ejecting" should read -- apparatus, the balance of the static head at the recording head ejecting --.

Column 12,
Line 25, "minimize" should read -- minimizes --;
Line 46, "it is desirable a bundle of fibers." should read -- a bundle of fibers is desirable. --; and
Line 48, "contactness" should read -- contact --.

Column 13,
Line 33, "means from" should read -- means 1056 --;
Line 58, "By the" should read -- The --;
Line 60, "Ink" should read -- Prevent ink --;
Line 61, "can be prevented" should be deleted; and
Line 65, "To prevent" should read -- Prevent --.

Column 14,
Line 1, "To prevent" should read -- prevent --;
Line 28, "contains" should read -- contained --;
Line 36, "extend," should read -- extent, --; and
Line 61, "(Y, X, C)" should read -- (Y, M, C) --.

UNITED STATES PATENT AND TRADEMARK OFFICE

CERTIFICATE OF CORRECTION

PATENT NO. : 6,116,722
DATED : September 12, 2000
INVENTOR(S) : Sato et al.

It is certified that error appears in the above-identified patent and that said Letters Patent is hereby corrected as shown below:

Column 15,
Line 58, "By the" should read -- The --;
Line 60, "Ink" should read -- prevent ink --;
Line 61, "can be prevented" should be deleted; and
Line 65, "To prevent" should read -- Prevent --.

Column 16,
Line 1, "To prevent" should read -- prevent --;
Line 4, "with" should read -- in --;
Line 6, "plans" should read -- plane --;
Line 25, "embodiment" should read -- embodiments --;
Line 47, "in" should read -- is --;
Line 54, "flows" should read -- flow --; and
Line 60, "of provision of" should read -- to provide --.

Column 17,
Line 9, "break" should read -- breaking --;
Line 14, "in" should read -- ink --;
Line 32, "602 is" should read -- 602, which is --;
Line 44, "breaks mechanically" should read -- mechanically breaks --;
Line 48, "retains" should read -- retained --; and
Line 60, "LE3" should read -- LB3 --.

Column 18,
Line 7, "faced to" should read -- facing --.

Column 19,
Line 5, "applies" should read -- applied --;
Line 21, "to" should be deleted;
Line 31, "is" should read -- be --; and
Line 54, "existing" should read -- existence --; and "Other" should read -- Another --.

Column 20,
Line 13, "Is" should read -- is --;
Line 25, "106k and" should read -- 106k, --; and
Line 44, "are" should read -- is --.

Column 21,
Line 17, "So" should read -- so --; and
Line 59, "apply" should read -- applies --.

UNITED STATES PATENT AND TRADEMARK OFFICE

CERTIFICATE OF CORRECTION

PATENT NO. : 6,116,722
DATED : September 12, 2000
INVENTOR(S) : Sato et al.

It is certified that error appears in the above-identified patent and that said Letters Patent is hereby corrected as shown below:

Column 22,
Line 19, "example" should read -- examples --;
Line 23, "FIG. 16, (a)." should read -- FIG. 16(a). --; and
Line 33, "positioned with" should read -- positioned. With --.

Column 23,
Line 3, "difference" should read -- different --; and "is" should read -- are --;
Line 8, "holder," should read -- holders, --;
Line 10, "are" should read -- be --;
Line 16, "container" should read -- containers --; and
Line 57, "160,,the" should read -- 160, the --.

Column 25,
Line 26, "tube" should read -- tubes --.

Column 26,
Line 2, "necessity for" should be deleted; and
Line 5, "a" should read -- an --.

Column 27,
Line 28, "in" should read -- ink --.

Column 28,
Line 60, "tube-provided" should read -- tube povided --.

Signed and Sealed this

Thirtieth Day of April, 2002

*Attest:*

*Attesting Officer*

JAMES E. ROGAN
*Director of the United States Patent and Trademark Office*